US008574806B2

(12) United States Patent
Yamanouchi et al.

(10) Patent No.: US 8,574,806 B2
(45) Date of Patent: Nov. 5, 2013

(54) IMAGE FORMING METHOD

(75) Inventors: Takao Yamanouchi, Kanagawa (JP); Kazue Nakamura, Tokyo (JP); Ryuichi Hiramoto, Tokyo (JP); Michiyo Fujita, Tokyo (JP)

(73) Assignee: Konica Minolta Business Technology, Inc., Tokyo (JP)

( * ) Notice: Subject to any disclaimer, the term of this patent is extended or adjusted under 35 U.S.C. 154(b) by 404 days.

(21) Appl. No.: 12/756,354

(22) Filed: Apr. 8, 2010

(65) Prior Publication Data

US 2010/0261108 A1 Oct. 14, 2010

(30) Foreign Application Priority Data

Apr. 13, 2009 (JP) ..... 2009-097059

(51) Int. Cl.
*G03G 13/00* (2006.01)

(52) U.S. Cl.
USPC ..... 430/126.1; 427/474

(58) Field of Classification Search
USPC ..... 430/126.1; 427/474
See application file for complete search history.

(56) References Cited

U.S. PATENT DOCUMENTS

| | | | | |
|---|---|---|---|---|
| 6,475,688 | B1 * | 11/2002 | Tamura et al. | 430/108.3 |
| 2007/0020549 | A1 * | 1/2007 | Koyama et al. | 430/109.3 |
| 2007/0048653 | A1 * | 3/2007 | Ide | 430/120 |
| 2008/0166653 | A1 * | 7/2008 | Matsubara et al. | 430/124.32 |

FOREIGN PATENT DOCUMENTS

| | | |
|---|---|---|
| JP | 11007174 | 1/1999 |
| JP | 2002341619 | 11/2002 |
| JP | 2004258537 | 9/2004 |
| JP | 2007140037 | 6/2007 |

* cited by examiner

*Primary Examiner* — Christopher Rodee
(74) *Attorney, Agent, or Firm* — Lucas & Mercanti, LLP

(57) ABSTRACT

An image forming method including a process for forming a transparent toner layer on an image formed on a support, the method including steps of supplying a transparent toner on an image on a support, and heating and then cooling the image on the support having the transparent toner while the image on the support having the transparent toner being in contact with a belt, wherein the transparent toner contains a resin constituted by a polyester and a styrene-acryl copolymer, a monoester compound represented by Formula I, and a hydrocarbon compound having at least one of a branched chain structure and a cyclic structure, $R^1$—COO—$R^2$ Formula I:

wherein, $R^1$ and $R^2$ are each a hydrocarbon group having 13 to 30 carbon atoms which may have a substituent or not, and $R^1$ and $R^2$ are the same or different.

18 Claims, 5 Drawing Sheets

IMAGE FORMING METHOD

This application is based on Japanese Patent Application No. 2009-97059 filed on Apr. 13, 2009, in Japanese Patent Office, the entire content of which is hereby incorporated by reference.

TECHNICAL FIELD

The present invention relates to an image forming method including a step for forming a transparent toner layer by using a colorless toner so called as transparent toner for providing gloss onto an image formed by a printing method such as an electrophotographic method, an ink-jet method or a presswork.

BACKGROUND

Recently, the printed image typified by photographic image and poster is formed by an ink-jet apparatus or an electrophotographic image forming apparatus additionally to usual silver halide photographic system and gravure printing method.

For instance, formation of an fine dot image on a level of 1200 dpi (dpi: dot number per inch (2.54 cm)) is made possible in the field of the image forming technology of electrophotography such as copying machine or printer accompanied with the progress in the technology such as digitalization of exposing system and minimizing of the toner diameter.

Moreover, a technology capable of forming a full color image is developed in which toner images are respectively formed on plural photoreceptor drums and the formed toner images are piled by primarily transferred onto an intermediate transferring member, and the image formed on the intermediate transferring member is secondarily transferred onto an image supporting member. As above-mentioned, the formation of full color image requiring high resolving power such as that of the photographic image can be realized by such the image forming method additionally to the usual silver halide photography or printing technology.

A glossy image is often required in a photographic image of poster, however, white background area with low glossiness of the image formed by the toner is obtained sometimes even though the images area fixed on the support such as a paper sheet has some degree of glossiness. Such the unbalance in the glossiness in the finished image causes degradation in the quality of the printed matter, therefore countermeasure to such the phenomenon is demanded.

On such the background, a technique is investigated, by which the image formation is carried out by using a toner constituted by omitting colorant from the usual color toner, so called as a transparent toner or transparent toner, for preventing the formation of ununiformity in the glossiness on the image. In concrete, a technique is disclosed, in which the transparent toner is uniformly provided on the whole surface of the support carrying the image and heated and cooled to form a transparent toner layer on the whole surface of the image for preparing a printed matter having uniform glossiness on the whole surface of the image; cf. Patent Document 1, for example. Moreover, a technique is disclosed in which a transparent toner layer is formed on the image formed by a printer by using a glossing apparatus to provide a glossy printed matter; of Patent Documents 2 and 3, for example.

Such the apparatus is connected with a printer such as an electrophotographic printer and the transparent toner layer is entirely formed on the surface of the image formed by the printer, and the transparent toner layer is melted by heating the layer in a state of contacting with a belt. And then the transparent toner layer is solidified by cooling while contacting with the belt. The printed matter is naturally released from the belt after solidifying of the transparent toner layer; thus the glossy printed matter is finished.

Furthermore, a full color image forming technique is known, in which difference of the physical properties between the image forming toner and the transparent toner is noted and the difference between the particle diameter of the colored toner and that of the transparent toner is specified to obtaining the uniform glossiness; cf. Patent Document 4, for example. A glossy surface having smoothness at a level on which an image can be mirrored by light on the surface can be obtained by such the techniques so that high quality glossy printed matters can be provided on the market.

In the technique disclosed in Patent Documents 2 and 3, however, the belt is gradually degraded by repeating the glossy surface formation since the heating and cooling are always carried out while contacting with the surface on which the transparent toner is provided. Cracks or flaws are caused on the belt surface accompanied with the degradation thereof. As a result of that, the irregularity of the belt surface such as the cracks and flaws is transferred onto the glossy surface of the image so that any uniform glossy surface without unevenness cannot be obtained when the degraded belt is used for forming the glossy surface.

Patent Document 1: JP-AH11-7174
Patent Document 2: JP-A2002-341619
Patent Document 3: JP-A2004-258537
Patent Document 4: JP-A2007-140037

SUMMARY OF THE INVENTION

Problems to be Solved by the Invention

The present invention is applied for forming a glossy surface by contacting the transparent toner surface of an image support on which an image is formed and a transparent toner is supplied, and heating and cooling the transparent toner while contacting to the belt, and the object of the invention is to provide an image forming method by using the transparent toner capable of constantly forming the smooth glossy surface. Concretely, the object of the invention is to provide the transparent toner by which the irregularity is not transferred onto the glossy surface even when the belt is degraded by repeating the glossy surface forming treatment so that the irregularity is caused by forming the cracks and flaws.

Namely, the object of the invention is to provide a transparent toner capable of stably forming a smooth glossy surface having a light reflecting ability of a level capable of mirroring an image even when the transparent toner layer is formed by using the degraded belt, and an image forming method using the transparent toner.

Means for Solving the Problems

It is found by the inventors that the above problems can be solved by any one of the following constitutions. The object of the invention can be attained by the following.

The image forming method including a process for forming a transparent toner layer on an image formed on a support by supplying a transparent toner on an image on a support, and heating and cooling a transparent toner while the image on the support having the transparent toner being in contact with a belt, in which the transparent toner contains a resin constituted by a polyester and a styrene-acryl type copolymer, a monoester compound represented by the following Formula I, and a hydrocarbon compound having at least one of a branched chain structure and a cyclic structure.

$R^1—COO—R^2$ Formula I:

In the above formula, $R^1$ and $R^2$ are each a hydrocarbon group having 13 to 30 carbon atoms which may have a substituent or not and the same or different.

The resin to be contained in the transparent toner is preferably prepared by that a polyester is formed by condensation polymerizing a polybasic carboxylic acid and a polyhydric alcohol in a state in which a styrene monomer and an acrylate monomer exist in an aqueous medium, and then the styrene monomer and the acrylate monomer are radical polymerized to form the styrene-acryl type copolymer.

The resin preferably has a peak of weight average molecular weight distribution within the range of from 10,000 to 30,000 and a peak within the range of from 40,000 to 100,000.

The melting point of the monoester compound represented by Formula I is preferably within the range of from 39° C. to 90° C.

Effect of the Invention

It is made possible by the invention that the smooth glossy surface can be formed even when the belt having irregularity caused by the degradation on the surface thereof on the occasion of forming the glossy surface by heating and cooling the image support having the image and the transparent toner thereon while contacting with the belt. In concrete, the transparent toner by which the printed matter with glossy surface at the level capable of reflecting light for mirroring image can be obtained without transferring of the irregularity on the belt surface even when the belt is degraded by repeating the glossy surface forming treatments and irregularity is caused by forming the cracks and flaws, and the image forming method using such the transparent toner can be provided.

PREFERRED EMBODIMENT OF THE INVENTION

Figure 1:
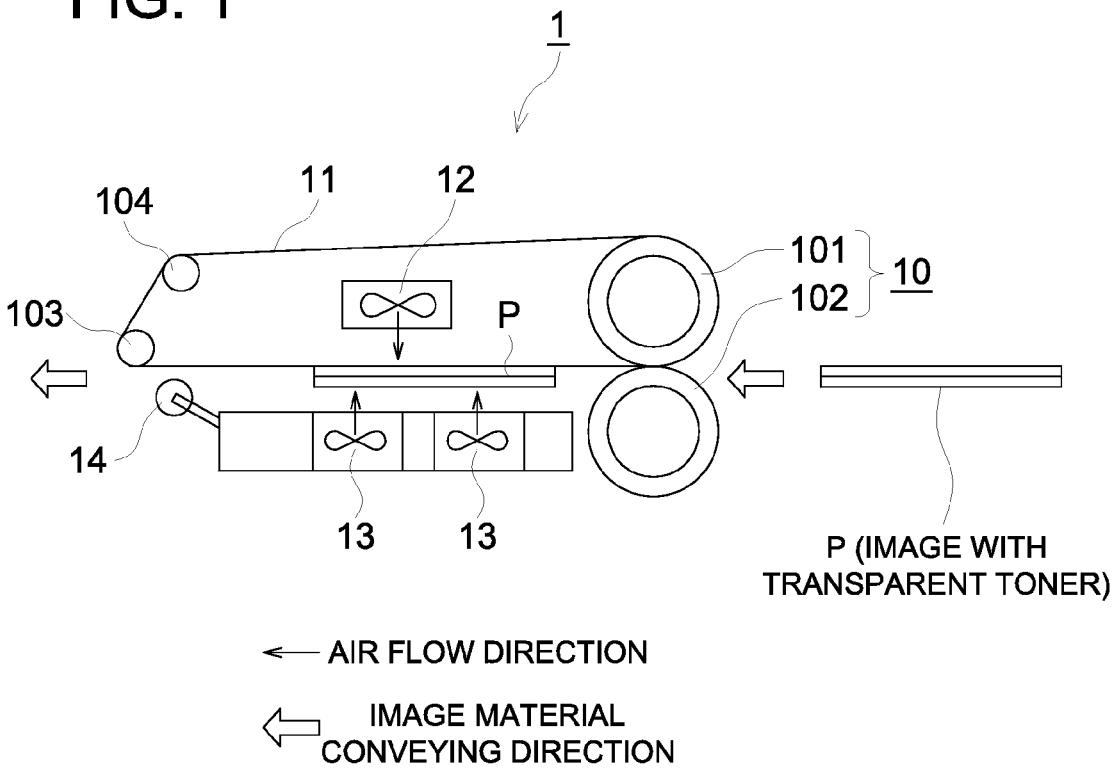
FIG. 1 shows the schematic drawing of a glossing apparatus capable of funning glossy surface by the transparent toner on the surface of the image formed on the image support.

The transparent toner of the invention is used for forming the glossy surface by heating and cooling the image support having the image and the transparent toner while contacting with the belt, and the toner is specifically constituted by the styrene-acryl type copolymer and the polyester.

It has been investigated by the inventors to develop the transparent toner by which the transparent toner layer having high glossiness capable of mirroring an image by light can be formed without transfer of the irregularity on the belt surface even when the transparent toner layer is formed by contacting with the belt on which cracks and flaws are formed. Firstly, development of a transparent toner capable of inhibiting the degradation of the belt is considered. Namely, the degradation is inhibited by preventing the formation of the cracks and scratches on the belt surface caused by repeating of the glossy surface formation by developing a transparent toner which can be melted at a relatively low heating temperature and solidified by not so much lowering the temperature.

Although the transparent toner having such the properties was developed by the inventors, sufficient results could not be obtained. It was supposed that the transparent toner adhered onto the belt surface during repeating of the glossy surface formation, and the transparent toner adhering on the belt surface was transferred onto the printed matter so as to lower the surface glossiness of the printed matter. It was considered that conditions such as to uniformly supply suitable amount of the transparent toner without unevenness onto the image support and to improve adhesion ability between the toner particles were also required.

It is found by the inventors that images with glossy surface having high image mirroring ability can be obtained by the transparent toner containing the resin constituted by the styrene-acryl type copolymer, the monoester compound having the specified structure and the hydrocarbon compound. As above-mentioned, the resin constituting the transparent toner of the invention contains plural kinds of polymer such as the styrene-acryl type copolymer formed by radical polymerization and the polyester formed by condensation polymerization.

The reason of that the transparent toner surface having high glossiness can be obtained by constituting the resin by the plural kinds of polymer different from each other in the structure is supposed as follows.

Firstly, it is considered that some degree of strength is added to the surface of the transparent toner layer by the polarization tendency of the polyester molecules constituting the resin. Namely, it is supposed that a kind of cross-linking structure is formed by intertwining of the polymer molecules by the effects of hydrogen bond and inter-molecule attractive force caused the polarity of the polyester molecules. The cross-linking structures are also formed between the toner particles as a result of formation of the cross-linking structure at many places so that the adhesion ability between the transparent toner particles is accelerated. Some degree of strength is provided to the toner layer surface as a result of that such the cross-links in the transparent toner layer are formed uniformly on the image support. It is supposed that the surface of the transparent toner layer is strengthen as above-mentioned so that the surface of the transparent toner layer is strengthen until the irregularity of the belt surface cannot be transferred.

It is considered as one of the reason of formation of high glossiness that the adhesion force of the styrene-acryl type copolymer component realized near the surface of the transparent toner layer is counteracted by the presence of the polyester component. The styrene-acryl type copolymer component has some degree of adhesive property, although that provides suitable melting ability to the transparent toner. Therefore, there is possibility of that the styrene-acryl type copolymer existing at the surface the transparent toner layer adheres onto the belt surface. It is anxious that the styrene-acryl type copolymer adhering on the belt is transferred onto the surface of the next transported printed matter and piled on the transparent toner layer of the next printed matter so as to lower the mirroring ability of the printed matter. In the invention, the exposition of the styrene-acryl type copolymer component to the surface of the transparent toner layer is made difficult by the presence of the polyester component at the transparent toner layer surface so as to inhibit the adhesion of the styrene-acryl type copolymer component to the belt. It is supposed that the image having the high image mirroring ability can be obtained as a result of the above.

Moreover, the transparent toner of the invention also contains the later-mentioned monoester compound and hydrocarbon compound. It is considered that these compounds also contribute to inhibit the transfer of the irregularity of the belt surface. It is further considered that some degree of rigidity is provided by the easily crystallizing property of the monoester compound so as to inhibit the adhesion with the belt surface. As a result of that, the irregularity on the belt surface is difficultly transferred to the transparent toner layer surface even when the belt has irregularity on the surface thereof.

However, it is considered that the degree of crystallization of the monoester compound is necessarily to make even for displaying the easily crystallizing property of the monoester keeping good balance, and the presence of the hydrocarbon compound contributes to make even the crystallization degree of the monoester compound. Namely, the hydrocarbon compound may inhibit the crystallization by forming space between the monoester compound molecules by that the hydrocarbon compound has affinity with monoester compound and the bulky moiety such as the branched chain structure or the cyclic structure. As above-mentioned, it is supposed that the easily crystallizing property of the monoester compound is controlled by the hydrocarbon compound by together using the monoester compound and the hydrocarbon compound so that stable rigidity is provided to the transparent toner surface and the adhesion with the belt surface is suitably inhibited. As a result of that, the irregularity may not be transferred to the transparent toner surface even when the belt surface has the irregularity.

It is considered that the glossy image surface having high mirroring ability can be obtained without the influence of the irregularity by the transparent toner of the invention even when the belt having the cracks or flaws are formed on the surface is used.

The invention is described in detail below.

In the invention, the "transparent toner" is a toner particle containing no colorant displaying coloring effect by light absorption or light scattering such as a coloring pigment, coloring dye, carbon black particle and ferromagnetic black powder. The transparent toners of the invention usually colorless, and some of them are lower in some degree in the transparency according to the kind or the adding amount of binder resin, wax and external additive constituting the transparent toner. However, the toner containing no colorant is referred to as "transparent toner", in the invention.

In the invention, the "image" is one having the state of medium capable of informing information such as images of characters or pictures to users. Namely, the "image" includes not only the area of the image support on which toner or ink exists but the area so called as white background on which no toner nor ink exists, and in the state capable of informing information to the users. The "image" of the invention includes both of one having the transparent toner layer and one having no transparent toner layer. In the invention, the method for forming the image before the formation of the transparent toner layer is not specifically limited, and ones prepared by usual image forming method such as electrophotographic system, printing work, ink-jet system of silver halide photographic system can be applied.

The "toner image" in the invention describes the area of the "image" except the area formed by using the transparent toner, and the foregoing "image having no transparent toner layer" is corresponding to the "toner image".

Firstly, the resin constituting the transparent toner of the invention is described below.

The resin constituting the transparent toner of the invention is constituted at least by the styrene-acryl type copolymer and the polyester. Examples of the resin constituting the transparent toner of the invention include one prepared by blending at least the styrene-acryl type copolymer and the polyester and a block copolymer formed by bonding the molecules of the styrene-acryl type copolymer and those of the polyester. Among them, the resin having the structure of the styrene-acryl type copolymer resin in which the polyester resin is introduced is preferable. The resin having such the structure can be produced by a usual method. For example, the resin can be prepared by the following procedure.

(1) A styrene monomer, an acrylate monomer, a polybasic carboxylic acid and a polyhydric alcohol are put into an aqueous medium and dispersed into the aqueous medium. The dispersion in which the above compounds are dispersed is heated for condensation polymerizing the polybasic carboxylic acid and the polyhydric alcohol to form the polyester.

(2) After formation of the polyester, the styrene monomer and the acrylate monomer are radical polymerized to form a styrene-acryl type copolymer resin. It is supposed that the radical polymerization is carried out on the surface of the polyester molecule on this occasion so that the styrene-acryl type copolymer bonding with the polyester molecule is formed. Thus, the resin constituted by the styrene-acryl type copolymer and the polyester is produced.

When the resin constituting the toner of the invention is formed, the polyester is formed by the condensation polymerization which is a dehydration reaction. However, the condensation polymerization of the polyester can be carried out even when the reaction is performed in the state of the monomers dispersed in the aqueous medium. The polybasic carboxylic acid and the polyhydric alcohol can be condensed in the aqueous medium because the polymerization reaction is progressed in an oil droplet formed by dispersing of the polymerizable monomers and the esterification reaction can be performed without influence of water being outside of the oil droplet. Namely, it is considered that the oil droplet is maintained by the presence of the styrene monomer and the acrylate monomer and the polybasic carboxylic acid preferentially reacts with the polyhydric alcohol each insulated from the aqueous medium by the oil droplet to form the polyester.

Water molecules are formed by the esterification reaction, which are necessarily removed to outside of the oil droplet, and a surfactant contained in the aqueous medium probably contributes to remove the water molecules. For example, when a surfactant having an acidic group is used, the hydrophilic acidic group and the hydrophobic long hydrocarbon chain group are each oriented to the aqueous medium side and the oil droplet side, respectively. It is supposed that the acidic group taking such the orientation catalytically acts to dehydration and removes the water molecule formed by the condensation polymerization from the oil droplet.

The radical polymerization for forming the styrene-acryl type copolymer is per formed in the state in which the polyester exists in the droplet; therefore it is considered that the resin formed after finishing of the polymerization reaction has a structure in which the polyester and the styrene-acryl type copolymer are finely and uniformly dispersed. Accordingly, it is supposed that the causing of offset on the occasion of the printing can be inhibited since the polyester is suitably exposed at the transparent toner surface when the transparent toner is produced by using the resin.

The poly valent carboxylic acid and polyalcohol to form the polyester applicable to this invention are described. The polyester applicable to this invention is formed by condensation polymerization of a poly valent carboxylic acid and a polyalcohol. The poly valent carboxylic acid is a two or more valent carboxylic acid compound, that is, a compound having two or more carboxylic groups (—COOH) in a molecule. The polyalcohol is a two or more valent alcohol compound, that is, a compound having two or more hydroxy groups (—OH) in a molecule.

The poly valent carboxylic acids to form the polyester applicable to this invention include an aliphatic or aromatic dicarboxylic acid and three or more valent carboxylic acid, and acid anhydride or chloride of the carboxylic acids mentioned above. Representative examples of the aliphatic or aromatic dicarboxylic acid and three or more valent carboxylic acid applicable to this invention are listed.

(A) Aliphatic Dicarboxylic Acids

Oxalic acid, malonic acid, succinic acid, glutaric acid, adipic acid, pimelic acid, suberic acid, azelaic acid, sebacic acid, maleic acid, fumaric acid, citraconic acid, itaconic acid, glutaconic acid, n-dodecyl succinic acid, n-dodecenyl succinic acid, isododecyl succinic acid, isododecenyl succinic acid, n-octyl succinic acid, and n-octenyl succinic acid.

(B) Aromatic Dicarboxylic

Phthalic acid, isophthalic acid, terephthalic acid, and naphthalene dicarboxylic acid.

(C) Carboxylic Acids Having a Valence of 3 or More

Trimellitic acid, and pyromellitic acid.

Polycarboxylic acids may be used alone or in combination in case of forming polyester capable of the invention. The use of carboxylic acids having a valence of 3 or more, as a polyvalent carboxylic acid can obtain hybrid resin particles having a cross-linkage structure formed in the polymerization stage. The content of such a carboxylic acid having a valence of 3 or more is preferably from 0.1 to 10% by mass, based on the total polyvalent carboxylic acids.

The polyalcohols to form the polyester applicable to this invention include an aliphatic or aromatic dialcohol (diol) and three or more valent alcohol, and polyalcohol derivatives such as an alkoxide or an alkyleneoxide of the polyalcohol mentioned above. Representative examples of the aliphatic or aromatic dials and three or more valent alcohols are listed.

(a) Diols

Ethylene glycol, diethylene glycol, triethylene glycol, 1,2-propylene glycol, 1,3-propylene glycol, 1,4-butanediol, 1,4-butylene diol, neopentylglycol, 1,5-pentane glycol, 1,6-hexane glycol, 1,7-heptane glycol, 1,8-octanediol, 1,9-nonane diol, 1,10-decane diol, pinacol, cyclopentane-1,2-diol, cyclohexane-1,4-diol, cyclohexane-1,2-diol, cyclohexane-1,4-dimethanol, dipropylene glycol, polyethylene glycols, polypropylene glycol, polytetramethylene glycol, bisphenol A, bisphenol Z, and hydrogen-added bisphenol A;

(b) Aliphatic or Aromatic Polyalcohols Having a Valence of 3 or More

Glycerin, trimethylol ethane, trimethylol propane, pentaerythritol, sorbitol, trisphenol PA, phenol novolak, and cresol novolak.

(c) Alkylene Oxide Adduct of a Polyvalent Alcohol of the Foregoing Aliphatic Polyalcohol Having a Valence of 3 or More.

The polyalcohol can be used singly or in combination of at least two kinds in case of forming the polyester capable in this invention. The use of a polyvalent alcohol having a valence of 3 or more can obtain a polyester resin having a crosslinking structure. The proportion of polyvalent alcohols having a valence of 3 or more or the alkylene oxide adduct thereof is preferably from 0.1% to 10% by weight, based on the total polyvalent alcohols.

In view of the ratio of the above-mentioned polyalcohol to polycarboxylic acid, an equivalent ratio of [OH]/[COOH] is preferably 1.5/1-1/1.5, and more preferably 1.2/1-1/1.2, where [OH] indicates hydroxyl groups in the polyalcohol, and [COOH] indicates carboxyl groups in the polycarboxylic acid. Polyester resin having a desired molecular weight can be assuredly acquired by arranging to set the ratio of polyalcohol to polycarboxylic acid in the above range.

Polyester resin capable in this invention has a weight-average molecular weight (Mw) of preferably 10,000 or more, and more preferably from 20,000 to 100,000, and a number-average molecular weight (Mn) of preferably 20,000 or less, and more preferably from 2,000 to 80,000, determined by gel permeation chromatography (GPC), respectively.

The glass transition point and softening point of polyester resin are preferably selected to be 20 to 90° C. and 80 to 220° C., respectively, and more preferably 35 to 65° C. and 80 to 150° C., respectively. The glass transition point is determined employing an on-setting technique when increasing the temperature in the second trial via a differential thermal analysis method, while the softening point can be determined employing a ½ method of an elevated type flow tester.

The polymerizable monomers to form styrene amyl based copolymer applicable to this invention is described. The polymerizable monomers to form the resin composing the transparent toner is obtained by radical polymerization of at least a styrene monomer and an acrylic acid ester monomer described below. The styrene monomer includes styrene represented by a formula of $CH_2{=}CH{-}C_6H_5$ and compounds having structures of side chain or functional group listed below. The acrylic acid ester monomer includes the acrylic acid ester compound represented by a formula of $CH_2{=}CHCOOR$ (wherein R is an alkyl group) and vinyl ester compounds having a side chain or a functional group such as methacrylic acid ester derivatives listed below.

Specific examples of styrene monomers and acrylic acid ester monomers to form the styrene acryl based copolymer applicable to this invention are listed below.

Examples of a styrene compound include,

Styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene and p-n-dodecylstyrene.

Representative examples of the acrylic acid ester monomer are acrylic acid ester monomer and methacrylic acid ester monomer shown below. Acrylic acid ester monomer includes methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate; and methacrylic acid ester monomer includes methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate and diethylaminoethyl methacrylate, dimethylaminoethyl methacrylate.

The acrylic acid ester monomers or methacrylic acid ester monomers may be used singly or two or more in combination. This means that it is possible to use any combinations of a kind of styrene monomer and two or more kinds of acrylic acid ester monomers, a kind of styrene monomer and two or more kinds of methacrylic acid ester monomers, and further a kind of styrene monomer, acrylic acid ester monomer and methacrylic acid ester monomer, to form the copolymer.

The styrene acryl based copolymer applicable to this invention includes copolymer formed using general vinyl monomers in combination in addition to the copolymer formed only by the styrene monomer and the acrylic ester monomer mentioned above. The styrene acryl based copolymer applicable to this invention includes a copolymer composed of only a styrene monomer and a acrylic ester monomer, as well as one composed of a vinyl monomer in addition to the styrene monomer and the acrylic ester monomer. The vinyl monomer to compose the styrene acryl copolymer applicable to this invention is listed.

(1) Olefins

Ethylene, propylene, isobutylene and the like.

(2) Vinyl Esters

Vinyl propionate, vinyl acetate, vinyl benzoate, and the like.

(3) Vinyl Ethers

Vinyl methyl ether, vinyl ethyl ether and the like.

(4) Vinyl Ketones

Vinyl methyl ketone, vinyl ethyl ketone, vinyl hexyl ketone, and the like.

(5) N-Vinyl Compounds

N-vinyl carbazole, N-vinylindole, N-vinylpyrrolidone and the like.

(6) Others

Vinyl compounds such as vinylnaphthalene, vinylpyridine, derivatives from acrylic acid or methacrylic acid such as acrylonitrile, methacrylonitrile acrylamide.

Further, resin having cross linking structure may be formed by employing the polyfunctional vinyl compound. The polyfunctional vinyl compound described above. Examples of the polyfunctional vinyl compound include divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, and neopentyl glycol diacrylate.

Further, it is possible to use a vinyl monomer having ionic dissociation groups at side chain. Examples thereof are those each having a substituent such as a carboxyl group, a sulfonic acid group and a phosphoric acid group as a ionic dissociation group, and there are practical examples are given.

Practical examples of vinyl monomer having carboxyl group include acrylic acid, methacrylic acid, maleic acid, itaconic acid, cinnamic acid, fumaric acid, monoalkyl maleate, monoalkyl itaconate.

Practical examples of vinyl monomer having sulfonic acid group include styrenesulfonic acid, allylsulfosuccinic acid, and 2-acrylamido-2-methylpropanesulfonic acid, and examples of vinyl monomer having phosphoric acid group include acidphosphoxyethyl methacrylate and 3-chloro-2-acidphosphoxypropyl methacrylate.

Content of the styrene monomer and the acrylic acid ester monomer to compose the styrene acryl copolymer applicable to this invention is not particularly restricted, and selected in optimum in view of adjusting a softening point or glass transition temperature point of the binder resin. Practically content of the styrene monomer is preferably 40 to 95 parts, more preferably 50 to 80 parts by weight based on the whole radical polymerizable monomers. The content of the acrylic acid ester monomer is preferably 5 to 60 parts by weight, more preferably 10 to 50 parts by weight based on the whole radical polymerizable monomers.

A styrene-acryl copolymer obtained in the radical copolymerization step preferably exhibits a weight average molecular weight (Mw) of 2,000 to 1,000,000 or a number average molecular weight (Mn) of 1,000 to 100,000. The weight average molecular weight (Mw) and the number average molecular weight (Mn) can be determined by gel permeation chromatography (GPC). The molecular weight distribution (Mw/Mn) is preferably from 1.5 to 100, and more preferably from 1.8 to 70. The use of a toner having a weight average molecular weight (Mw), a number average molecular weight (Mn) and a molecular weight distribution (Mw/Mn) falling with the foregoing range can inhibit the offset phenomenon occurred in the fixing stage of the image formation process. The glass transition temperature point of the styrene-acryl copolymer obtained in the radical copolymerization is preferably 30 to 70° C., and the softening point of 80 to 170° C. Good fixing ability is obtained having the glass transition temperature point and softening point within the above mentioned range.

The number average molecular weight Mn and weight average molecular weight of the resin composing the transparent toner are possible to be determined by a method of molecular weight measurement. One of the representative example of the measurement procedure of molecular weight measured by the gel permeation chromatography method (GPC) employing tetrahydrofuran as a column solvent will be described here.

The measurement is conducted by the following procedures. First, 1 ml of a degassed tetrahydrofuran (THF) is added into 1 mg of a measured resin sample and stirred using a magnetic stirrer at room temperature until sufficiently dissolved. Subsequently, after filtering through a membrane filter having a pore size of 0.45-0.50 μm, a sample for measurement of the GPC is prepared.

Measurement is conducted under the condition that after the GPC measurement column being stabilized at 40° C., tetrahydrofuran flows at a rate of 1 ml per minute and 100 μl of a sample having a concentration of 1 mg/ml is injected to conduct the measurement. Combined use of commercially available polystyrene gel columns is preferred. Examples thereof include combinations of Shodex GPC KF-801, 802, 803, 804, 806 and 807 (produced by Showa Denko Ca, Ltd.); the combination of TSK gel G1000H, G2000H, G3000H, G4000H, G5000H, G6000H, G7000H and TSK guard column (produced by TOSOH CORP.).

A refractive index detector (IR detector) or a UV detector is preferred as the detector used. The molecular weight of a sample is represented by a molecular weight in terms of styrene resin conversion. The molecular weight in terms of styrene resin conversion is determined by a styrene calibration curve. About 10 points of monodisperse polystyrene standard polystyrene may preferably be measured to prepare a styrene calibration curve.

The molecular weight can be measured, for example, in the following condition.

Measuring Condition

Apparatus: HLC-8020 (Toso Corporation)

Column: GMHZL×2, G2000HXL×1

Detector: At least one of RI and UV

Effluent rate: 1.0 ml/min.

Sample content: 0.01 g/20 ml

Sample amount: 100 μl

Calibration curve: Prepared by standard polystyrene

The monoester compound and the hydrocarbon compound contained in the transparent toner are described. The transparent toner according to this invention contains the monoester compound represented by Formula I and the hydrocarbon compound having at least one of branched structure and cyclic structure. It is considered that a smooth glossy surface having a light reflecting ability with high level capable of mirroring an image can be formed even when the transparent toner layer is formed by using the degraded belt by employing the monoester compound and the hydrocarbon compound in combination.

Releasing activity of the monoester compound represented by Formula I inhibits adhesiveness between transparent toner surface and belt surface, and roughness of the belt surface is not transferred easily even though the belt has such roughness. And further the inventors consider that degree of the crystallization of the monoester compound can be made uniform by employing the hydrocarbon compound having at least one of branched structure and cyclic structure to avoid the affect of crystallization of the monoester compound. The roughness of the belt surface is inhibited to be transferred to clear surface and the degree of crystallization of the monoester compound is made uniform by employing the monoester compound and the hydrocarbon compound in combination. It is realized that transparent toner causing no light scattering is formed.

The monoester compound represented by Formula I, and the hydrocarbon compound having a branched chain structure or a cyclic structure used in this invention are described below.

The monoester compound incorporated in transparent toner elating to this invention is composed of a fatty acid component $R^1$ and alcohol component $R^2$ as represented by Formula I.

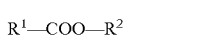

$$R^1—COO—R^2 \quad \text{Formula I}$$

wherein $R^1$ and $R^2$ are each independently a hydrocarbon group having 13 to 30 carbon atoms, which may be substituted $R^1$ and $R^2$ may be the same or different.

Specific examples of a monoester compound represented by Formula I include the following compounds (1-1) to (1-12). However the monoester compound represented by Formula I is not restricted to the following compounds.

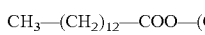

$$CH_3—(CH_2)_{12}—COO—(CH_2)_{13}—CH_3 \quad (1\text{-}1)$$

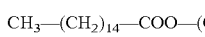

$$CH_3—(CH_2)_{14}—COO—(CH_2)_{15}—CH_3 \quad (1\text{-}2)$$

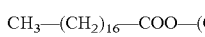

$$CH_3—(CH_2)_{16}—COO—(CH_2)_{17}—CH_3 \quad (1\text{-}3)$$

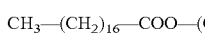

$$CH_3—(CH_2)_{16}—COO—(CH_2)_{21}—CH_3 \quad (1\text{-}4)$$

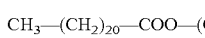

$$CH_3—(CH_2)_{20}—COO—(CH_2)_{17}—CH_3 \quad (1\text{-}5)$$

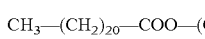

$$CH_3—(CH_2)_{20}—COO—(CH_2)_{21}—CH_3 \quad (1\text{-}6)$$

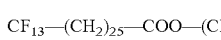

$$CF_{13}—(CH_2)_{25}—COO—(CH_2)_{25}—CH_3 \quad (1\text{-}7)$$

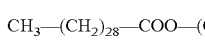

$$CH_3—(CH_2)_{28}—COO—(CH_2)_{29}—CH_3 \quad (1\text{-}8)$$

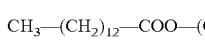

$$CH_3—(CH_2)_{12}—COO—(CH_2)_{12}—CH_3 \quad (1\text{-}9)$$

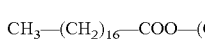

$$CH_3—(CH_2)_{16}—COO—(CH_2)_{16}—CH_3 \quad (1\text{-}10)$$

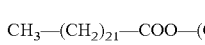

$$CH_3—(CH_2)_{21}—COO—(CH_2)_{21}—CH_3 \quad (1\text{-}11)$$

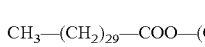

$$CH_3—(CH_2)_{29}—COO—(CH_2)_{29}—CH_3 \quad (1\text{-}12)$$

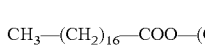

$$CH_3—(CH_2)_{16}—COO—(CH_2)_{12}—CH_3 \quad (1\text{-}13)$$

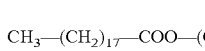

$$CH_3—(CH_2)_{17}—COO—(CH_2)_{14}—CH_3 \quad (1\text{-}14)$$

It is possible to use one kind or two or more kinds of monoester compounds in combination represented by Formula I in this invention.

The monoester compound represented by the Formula I has preferably a melting point of 30 to 100° C. and more preferably 39 to 90° C. Measurement of the monoester compound represented by the Formula I is generally called measurement of transparent melting point. The measurement of transparent melting point is conducted by recording melting process when the temperature and transmittance are measured simultaneously of a solid sample, and the melting point is measured by obtaining temperature at commencement and completion of melting of the sample based on the change of light transmittance.

Practically a transparent sample of monoester compound powder is filled into a predetermined capillary tube, and it is put into oven and melting procedure is observed by light beam. When the sample becomes transparent due to melting, amount of receiving light increases, and a signal change corresponding to increase of receiving light is detected by a circuit. The melting point of the monoester compound is measured by the result thereof. Apparatus to measure the transparent melting point of the monoester compound used in this invention obtained in the market is, for example, an automatic meting point measuring apparatus FP90/FP81HT, manufactured by Mettler Toledo.

The automatic meting point measuring apparatus manufactured by Mettler Toledo is composed of a control unit FP90 and measuring oven FP81HT. The condition for measuring transparent melting point of the monoester compound used in this invention is as follows.

Control Unit
Read accuracy: 0.1° C.
Temperature Sensor: PT100
Rate of rising temperature: 10° C./min. (selectable 0-20° C./min.)
Function: Melting point (Melting commencement temperature, melting complete temperature)
Measuring Oven
Heating method: Heater Block
Measuring points: Melting point, 3 Cloud points
Measuring range: Room temperature to 375° C.
Reproduce accuracy. Melting point 0.1° C. (measuring benzoic acid with purity of 99.99% at Rate of rising temperature of 0.2° C.)
Capillary tube having external diameter of 2.0 to 3.1 mm and a length of 80 mm can be used.

The hydrocarbon compound having a branched chain structure or a cyclic structure applicable to the transparent toner relating to this invention is described below. The transparent toner contains at least one of a hydrocarbon compound having a branched chain structure and a hydrocarbon compound cyclic structure described below, and each of the compounds may be used in combination. The hydrocarbon compounds are considered to have a releasing function by itself as well as a function to make the degree of the crystallization uniform by inhibiting crystallization of the monoester compound during cooling the transparent toner layer, as described above.

The hydrocarbon compound having a branched chain structure applicable to the transparent toner relating to this invention preferably comprise tertiary and quaternary carbon atoms in a ratio of 0.1% to 20% of total carbon atoms constituting the hydrocarbon compound having a branched chain structure. The ratio of the tertiary and quaternary carbon atoms of total carbon atoms can be measured by a method described below.

When the ratio of the tertiary and quaternary carbon atoms of total carbon atoms composing the hydrocarbon compound having a branched chain structure satisfies a condition shown above, it is considered that more effective interaction between the hydrocarbon compound having a branched chain structure and the monoester compound is demonstrated.

Specifically, the branching ratio of a hydrocarbon compound having a branched chain structure can be determined according to the following equation (2) based on a spectrum obtained in $^{13}$C-NMR spectrometry under conditions as below:

$$\text{Branching ratio}(\%)=[(C3+C4)/(C1+C2+C3+C4)]\times 100$$

wherein C3 represents a peak area related to tertiary carbon atoms, C4 represents a peak area related to quaternary carbon atoms, C1 represents a peak area related to primary carbon atoms and C2 represents a peak area related to secondary carbon atoms.

Condition of $^{13}$C-NMR spectrometry:

Measuring apparatus: FT NMR spectrometer Lambda 400 (produced by JEOL Ltd.)

Measuring frequency: 100.5 MHz

Pulse condition: 4.0 μs

Data point: 32768

Delay time: 1.8 sec

Frequency range: 27,100 Hz

The number of integrating: 20,000

Measurement temperature: 80° C.

Solvent: benzene-$d^6$%-dichlorobenzene-$d^4$=¼ (v/v)

Sample concentration: 3% by mass

Sample tube: diameter of 5 mm

Measurement mode: 1H complete decoupling method.

Specific examples of a hydrocarbon compound having a branched chain structure include microcrystalline waxes such as HNP-0190, Hi-Mic-1045, Hi-Mic-1070, Hi-Mic-1080, Hi-Mic-1090, Hi-Mic-2045, Hi-Mic-2065 and Hi-Mic-2095 (produced by Nippon Seiro Co., Ltd.) and waxes mainly containing an iso-paraffin wax, such as waxes EMW-0001 and EMW-0003.

A microcrystalline wax which is one of petroleum waxes and differs from a paraffin wax which is mainly comprised of a straight chain hydrocarbon (normal paraffin), is a wax in which the proportion of branched chain hydrocarbons (isoparaffin) and cyclic hydrocarbons (cycloparaffin) is relatively high. Generally, a microcrystalline wax, which is mainly comprised of low-crystalline isoparaffin and cycloparaffin, is composed of smaller crystals and exhibits a larger molecular weight, 25 to 60 carbon atoms, and a weight-average molecular weight of 500 to 800 and a melting point of 60 to 95° C.

A microcrystalline wax, as a hydrocarbon compound having a branched chain structure is preferably one having 30 to 60 carbon atoms, a weight-average molecular weight of 600 to 800 and a melting point of 60 to 95° C. Further, a paraffin wax having a number-average molecular weight of 300 to 1,000, is preferred and ore preferably 400 to 800. The ratio of weight-average molecular weight to number-average molecular weight (Mw/Mn) is preferably from 1.01 to 1.20.

Manufacturing methods to obtain a hydrocarbon compound having a branched chain structure include, for example, a press-sweating method in which solidified hydrocarbon is separated, while maintaining raw oil at a specific temperature and a solvent extraction method in which a solvent is added to raw oil of vacuum distillation residual oil or heavy distillates of petroleum to cause crystallization and is further subjected to filtration. Among these methods, the solvent extraction method is preferred. A hydrocarbon compound having a branched chain structure which was obtained by the manufacturing methods described above is colored and may be purified by using a sulfuric acid clay and the like.

Conventional wax described below may be used in combination with the monoester compound represented by Formula I, and the hydrocarbon compound having a branched chain structure or a cyclic structure in the transparent toner relating to this invention.

(1) Polyolefin type wax such as polyethylene wax and polypropylene wax.

(2) Long chain hydrocarbon type wax such as paraffin wax and SASOL wax.

(3) Dialkyl ketone type wax such as distearyl ketone;

(4) Ester type wax such as carnauba wax, montan wax, trimethylol propane tribehenate, pentaerythritol tetramyristate, pentaerythritol tetrastearate, pentaerythritol tetrabehenate, pentaerythritol diacetate dibehenate, glycerin tribehenate, 1,18-octadecane dial distearate, tristearyl trimellitate, and distearyl maleate; and (5) Amide type wax such as ethylene diamine dibehenylamide and tristearylamide trimellitate.

The melting point of the wax is normally 40 through 125° C., preferably 50 through 120° C., more preferably 60 through 90° C. When the melting point is kept within the range, the heat-resistant storage stability of toner is ensured, and glossy surface is stably formed even when transparent toner layer is molten at low-temperature. The total amount of waxes of monoester compound represented by Formula I, and the hydrocarbon compound having a branched chain structure or a cyclic structure contained in the transparent toner is preferably 1 percent by mass through 30 percent by mass, more preferably 5 percent by mass through 20 percent by mass.

A preparation method of the transparent toner in relation to this invention is described.

Manufacturing method of transparent toner is described.

The transparent toner is composed of particles comprising the resin constituting constituted at least by the styrene-acryl type copolymer and the polyester, and a monoester compound represented by the following Formula I, and a hydrocarbon compound having at least one of a branched chain structure and a cyclic structure. The resin is manufactured, for example, polymerizable monomer is poured into an aqueous medium and dispersed at first, and polyester is formed by condensation polymerization of poly carboxylic acid and polyalcohol in the presence of a styrene monomer and an acryl ester monomer. Then, the styrene acryl copolymer is formed by radical polymerization of the styrene monomer and an acryl ester monomer, and thus the resin is manufactured.

The manufacturing method of the conventional toner used for an image funning method of the electrophotography can be applied to the manufacturing method of the transparent toner. Such toner manufacturing methods can applicable as a pulverization method in which the toner is manufactured by processes of kneading, pulverization and classifying, and a polymerization method in which polymerizable monomers are polymerized in a aqueous medium and simultaneously particles are formed while particle shape and particle size are controlled.

The transparent toner manufactured by polymerization method is easy to obtain characteristics of uniform particle size distribution, sharp charge distribution and so on. The toner manufacturing method by polymerization includes a process forming resin particles by polymerization reaction such as suspension polymerization or emulsion polymerization. It is particularly preferable to manufacture including association process in which resin particles prepared by polymerization reaction are subjected to coagulation and fusion.

Transparent toner having core shell structure may be manufactured which has compatibility of low temperature fixing property and storage ability against high temperature by the manufacturing method including association process. Transparent toner having core shell structure is manufactured by forming core by resin particles having low softening point and glass transition point at first, then forming shell on the surface of the core by coagulation and fusion of resin particles having high softening point and glass transition point, whereby the transparent toner having core shell structure can be manufactured A manufacturing method of the transparent toner by emulsion association method is described as an example. The A manufacturing method of the transparent toner by emulsion association method is conducted, for example, by the following processes.

(1) Process of preparation of dispersion liquid of resin microparticles (2) Process of coagulation and fusion of the resin microparticles (3) Process of ripening (4) Process of cooling (5) Process of washing (6) Process of drying (7) Process of adding an external additive Each process is described.

(1) Process of Preparation of Dispersion Liquid of Resin Microparticles

Resin composed of polyester and styrene-acryl copolymer for forming the transparent toner is formed in this process. For example, at least styrene monomer, acrylic acid ester monomer, polycarboxylic acid and polyalcohol are added and dispersed in an aqueous medium, polycarboxylic acid and polyalcohol are subjected to condensation polymerization in this state to form polyester. Then, styrene acryl copolymer is formed by radical polymerization of styrene monomer and acrylic acid ester monomer to form resin microparticles having particle size of about 100 nm.

A resin composed of polyester and styrene acryl copolymer is formed by this process, and resin microparticles used in the coagulation and fusion process, described later, are manufactured. In a manufacturing method of the resin microparticles of polyester and styrene acryl copolymer, for example, styrene monomer, acrylic acid ester monomer, polycarboxylic acid and polyalcohol are added in an aqueous medium, and are subjected to dispersion processing to form oil droplets of the polymerizable monomers. Consequently polyester is formed, at first, by condensation polymerization inside of the oil droplets dispersed and formed in the aqueous medium. Then styrene acryl copolymer is formed by radical polymerization inside of the oil droplets. Resin particles of uniform mixture of polyester and styrene acryl copolymer can be manufactured by such procedures.

The manufacturing process of the resin microparticles includes a condensation polymerization process wherein polyester is formed by condensation polymerization of polycarboxylic acid and polyalcohol in the aqueous medium and a radical polymerization process wherein styrene acryl copolymer is formed by radical polymerization of styrene compound and acryl acid ester compound. The condensation polymerization process and the radical polymerization process are described.

(a) Condensation Polymerization Process

Polyester is formed by polymerization reaction of the poly carboxylic acid and polyalcohol in the condensation polymerization process. At least styrene monomer, acrylic acid ester monomer, polycarboxylic acid and polyalcohol are added and dispersed in an aqueous medium, polycarboxylic acid and polyalcohol are subjected to condensation polymerization in this state to form polyester.

The reason why the condensation polymerization, which is an equilibrium reaction accompanying dehydration reaction, can be conducted inside of the oil droplets dispersed in an aqueous medium is probably considered as follows. A surfactant containing acid group is considered to have a structure in which the hydrophilic acid group is oriented to aqueous phase and the hydrophobic long chain hydrocarbon group to oil phase in an aqueous medium. Therefore, the above mentioned acidic group exhibits an effect of dehydration catalyser at the interface between the oil droplets and aqueous medium phase, and accelerates removing water from oil droplets, and consequently, progresses the condensation polymerization reaction accompanying dehydration from the droplets.

Temperature at the condensation polymerization, which varies depending on the kinds of poly carboxylic acid and polyalcohol, is preferably 40 to 150° C., and more preferably 50 to 100° C. under the boiling point of water because of the condensation polymerization is conducted stably in an aqueous medium. Time for polymerization, which varies depending on reaction rate of condensation polymerization, is preferably 4 to 10 hours.

(b) Radical Polymerization Process

The radical polymerization process is a process to form styrene acryl copolymer inside of the oil droplets by polymerization of styrene monomer and acrylic ester monomer by polymerization initiator incorporated within the oil droplets generating radical. The radical polymerization may be initiated by a radical which is generated from polymerization initiator incorporated in the aqueous medium and supplied into the oil droplets.

Temperature at the radical polymerization, which varies depending on the kinds of styrene monomer and acrylic ester monomer, is preferably 50 to 100° C., and more preferably 55 to 90° C. Time for polymerization, which varies depending on reaction rate of condensation polymerization of styrene monomer and acrylic ester monomer, is preferably 5 to 12 hours.

The resin composed of polyester and styrene acryl copolymer can be manufactured by these two polymerization processes. The order of two processes are not limited and it is preferable that polyester is formed by the condensation polymerization reaction at first, then styrene acryl copolymer is formed by radical polymerization reaction in the presence of the polyester.

The polymerization can be conducted by that the monoester compound represented by Formula I and hydrocarbon compound having a branched or cyclic structure are dissolved or dispersed in the radical monomer compound and polymerization is conducted in the aqueous medium. The resin particles containing the monoester compound represented by Formula I and hydrocarbon compound having a branched or cyclic structure can be obtained in such way. The resin particles containing above mentioned wax can be obtained by that the wax is dissolved or dispersed in the radical monomer compound and polymerization is conducted in the aqueous medium.

Oil droplets of the monomers are formed by that the styrene monomer, acrylic acid ester monomer, polycarboxylic acid and polyalcohol are added and dispersed in an aqueous medium and these are subjected to dispersion process via an activity of mechanical energy. Dispersion apparatus in which oil droplets dispersion is carried out via application of mechanical energy are not particularly limited, but examples thereof include "CLEARMIX", ultrasonic homogenizers, mechanical homogenizers, Manton-Gaulin, and pressure system homogenizers. Further, the dispersed particle diameter of the polymerizable monomer solution is preferably about 100 nm.

The aqueous medium refers to a medium containing water in an amount of at least 50% by mass. As components other than water is cited water-soluble organic solvents and examples thereof include methanol, ethanol, isopropanol, butanol, acetone, methyl ethyl ketone and tetrahydrofuran. Of these solvents, it is preferred to use organic solvents which do not dissolve a resin, for example, alcoholic solvents such as methanol, ethanol, isopropanol and butanol.

(2) Process of Coagulation and Fusion of the Resin Microparticles

This is a process to form particles by coagulating resin microparticles formed by the above described process and to form mother particles for transparent toner having no external additives by fusing the coagulated particles, and is called a process for coagulating resin microparticles. Particles having particle diameter corresponding to toner particles by coagulating and fusing the resin microparticles composed of polyester and styrene acryl copolymer. The resin microparticles contain the monoester compound represented by Formula I and the hydrocarbon compound having a branched or cyclic structure, and therefore, the particles containing the monoester compound represented by Formula I and the hydrocarbon compound having a branched or cyclic structure are obtained by coagulating and fusing the resin microparticles.

In this step, a coagulant of an alkali metal salt or an alkaline earth metal salt such as magnesium chloride is added to an aqueous medium containing resin particles to coagulate these particles. Subsequently, the aqueous medium is heated at a temperature higher than the glass transition temperature of the resin particles to allow coagulation to proceed and to allow coagulated resin particles to fuse. When allowing coagulation to proceed and reach the targeted particle size, a salt such as sodium chloride is added to stop coagulation.

(3) Ripening:

Ripening is performed preferably by using thermal energy (heating). Specifically, a system including coagulated particles is stirred with heating, while controlling the heating temperature, a stirring speed and heating rate until the shape of toner particles reaches the intended average circularity.

(4) Cooling:

This step refers to a stage that subjects a dispersion of the foregoing toner particles to a cooling treatment (rapid cooling). Cooling is performed at a cooling rate of 1 to 20° C./min. The cooling treatment is not specifically limited and examples thereof include a method in which a refrigerant is introduced from the exterior of the reaction vessel to perform cooling and a method in which chilled water is directly supplied to the reaction system to perform cooling.

(5) Washing:

In the washing step, a solid-liquid separation treatment of separating toner particles from a toner particle dispersion is conducted, then cooled to the prescribed temperature in the foregoing step and a washing treatment for removing adhered material such as a surfactant or salting-out agent from a separated toner particles (aggregate in a cake form) is applied.

In this step, washing is conducted until the filtrate reaches a conductivity of 10 μS/cm. A filtration treatment is conducted, for example, by a centrifugal separation, filtration under reduced pressure using a Buchner's funnel or filtration using a filter press, but the treatment is not specifically limited.

(6) Drying:

In this step, the washed toner cake is subjected to a drying treatment to obtain dried colored particles. Drying machines usable in this step include, for example, a spray dryer, a vacuum freeze-drying machine, or a vacuum dryer. A standing plate type dryer, a movable plate type dryer, a fluidized-bed dryer, a rotary dryer or a stirring dryer is preferably used.

The moisture content of the dried toner particles is preferably not more than 5% by mass, and more preferably not more than 2%. When toner particles that were subjected to a drying treatment are aggregated via a weak attractive force between particles, the aggregate may be subjected to a pulverization treatment. Pulverization can be conducted using a mechanical pulverizing device such as a jet mill, Henschel mixer, coffee mill or food processor.

(7) External Additive Addition:

In this external additive treatment step, external additives or a lubricant is added to dried transparent toner parent particles. Transparent toner parent particles which were subjected to the drying step may be used as toner particles, but addition of external additives can enhance the electrostatic-charging property, fluidity and cleaning property. External additives usable in the present invention include, for example, organic or inorganic particles and aliphatic metal salts. An external additive is added preferably in an amount of 0.1 to 10.0% by mass, and more preferably 0.5 to 4.0% by mass. A variety of additives may be combined. Examples of a mixing device, used to add external additives include a tabular mixer, a HENSCHEL MIXER, a NAUTA Mixer, a V-type mixer and a coffee mill.

The transparent toner can be manufactured by the emulsion association method mentioned above.

Surfactants, polymerization initiator, dispersion stabilizer and so on used in the manufacturing the transparent toner are described.

The surfactants which can be used in the manufacturing the transparent toner are described. Conventional surfactant can be used in the manufacturing the transparent toner. It is preferable those accelerating condensation polymerization of polycarboxylic acid and polyalcohol within the above described oil droplets. Practically, those having a hydrophilic functional group and a hydrophobic functional group in a molecule structure, are preferable, and includes, for example, a surfactant containing acid group having hydrophilic acid group and hydrophobic long chain hydrocarbon group.

"Long chain hydrocarbon group" means a hydrocarbon group structure having a carbon number of 8 or more in the backbone. The long chain hydrocarbon group includes an alkyl group and an aromatic hydrocarbon group which may contain an alkyl group each having a carbon number of 8 to 40, and in particular, a phenyl group having an alkyl group having a carbon number of 8 to 30 among them.

The acid group is preferably one exhibiting high acid in an aqueous medium, for example, a sulfonic acid group, carboxylic acid group, and phosphoric acid group, and those having a sulfonic acid group or carboxylic acid group are preferable. Practical example of the sulfonic acid group includes dodecyl sulfonic acid, eicosyl sulfonic acid, decyl benzenesulfonic acid, dodecylbenzenesulfonic acid, eicosyl benzenesulfonic acid, 3,3-disulfondisphenylurea-4,4-diazo-bis-amino-8-naphthol-6-sulfonic acid, ortho-carboxybenzene-azo-dimethylaniline, 2,2,5,5-tetramethyl-triphenylmethane-4,4-diazo-bis-(3-naphthol-6-sulfonic acid. An example of the surfactant having carboxylic acid includes dodecyl carboxylic acid, and an example of phosphoric acid includes dodecyl phosphoric acid and eicosyl phosphoric acid.

The content of an acidic group-containing surfactant contained in the aqueous medium is commonly not more than the critical micelle concentration, specifically at most 80% of the critical micelle concentration, and is preferably at most 70% of critical micelle concentration. Oil droplets can be formed stably without forming micelle by making the concentration of the surfactant not more than the critical micelle concentration. It is considered that all surfactants is orientated around the oil droplets so as to stabilize the formed oil droplets by allowing an excess amount of the surfactant exists. It is supposed that the rate of condensation polymerization reaction is enhanced by that removing water from oil droplets formed within the oil droplets is accelerated during the condensation polymerization since the surfactant is thus orientated.

The acidic group-containing surfactant content is 0.01 to 2% by weight, and preferably 0.1 to 1.5% by weight, based on the weight of the aqueous medium, since the content is preferably not more than critical micelle concentration as mentioned above.

An ionic surfactant or a nonionic surfactant may appropriately be contained in an aqueous medium to stabilize oil droplets of the polymerizable monomers.

The surfactant other than the ionic type surfactant having sulfonic acid group described above includes sulfonates and fatty acid salts. Examples of sulfonates include sodium dodecylsulfonate, sodium tetradecylsulfonate, sodium pentadecylsulfonate, and sodium octylsulfonate; fatty acid salts such as sodium oleate, sodium laurate, and sodium caprate, sodium caprylate, sodium caproate, potassium stearate, and calcium oleate.

Nonionic surfactants are also usable. Examples thereof include polyethylene oxide, polypropylene oxide, a combination of polypropylene oxide and polyethylene oxide, an ester of polyethylene glycol and a higher fatty acid, alkylphenol polyethylene oxide, an ester of polypropylene oxide and a higher fatty acid, and sorbitan ester.

It is preferred to use a dispersion stabilizer to stabilize the oil droplets of the polymerizable monomer in an aqueous medium. Practical example of the dispersion stabilizer includes tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina The following surfactants can be used as the dispersion stabilizer; polyvinyl alcohol, gelatin, methylcellulose, sodium dodecylbenzene sulfonate, ethylene oxide adducts and sodium higher alcohol sulfate.

The resin composing the transparent toner includes styrene acryl copolymer formed by polymerization of styrene monomer and acryl acid ester monomer. Oil soluble or water soluble polymerization initiator in a process forming styrene acryl copolymer can be used.

There are usable oil-soluble polymerization initiators include the following azo, diazo or peroxide initiators;

(1) Azo-Type or Diazo-Type Polymerization Initiators 2,2'-azobis-(2,4-dimethylvaleronitrile), 2,2'-azobisisobutyronitrile, 1,1'-azobiscyclohexanone-1-carbonitrile), 2,2'-azobis-4-methoxy-2,4-dimethylvaleronitrile, azobisisobutyronitrile, and the like. (2) Peroxide based polymerization initiators (2) Peroxide Type Initiators Benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxy-cyclohexane)propane, and tris-(t-butylperoxy) triazine, and the like.

Water-soluble radical polymerization initiator can be used for forming resin microparticles by emulsion polymerization method. Examples of a water-soluble polymerization initiator include persulfates such as potassium per sulfate and ammonium persulfate, azobisaminodipropane acetate, azobiscyanovaleric acid and its salts, and hydrogen peroxide.

Chain-transfer agents are usable for the purpose of controlling the molecular weight of a binding resin. Examples of the chain-transfer agents include mercaptans such as n-octylmercaptan, n-dodecylmercaptane and tert-dodecylmercaptan, n-octyl-3-mercaptopropionic acid ester, terpinolene, carbon tetrabromide, carbon and α-methylstyrene dimmer.

A gloss providing device will be explained, in which, the transparent toner according to the present invention is provided on the image support material on which an image is formed, and the transparent toner is heated and then cooled while the transparent toner is in contact with a belt member to form a glossy surface on the image support material. FIG. 1 is a schematic diagram showing a typical example of a gloss providing device which forms a glossy surface of the image surface employing the transparent toner according to the present invention.

The gloss-providing device 1 shown in FIG. 1 has at least the following constitutions.

(1) Heating and pressing device 10 in which image support material P on which the transparent toner is provided on the image is heated while being pressed, wherein heating and pressing the transfer material having thereon the image while the transfer material is in contact with a belt;

(2) Belt member 11 which contacts the transparent toner layer which is melted by the heating and pressing device 10 to form a contact surface between the transparent toner surface, and conveys the image support material P;

(3) Cooling fans 12 and 13 which supply cooling air to the image support material P which is being conveyed while being in contact with belt member 11;

(4) Conveyance roll 14 which conveys the image support material P on which the transparent toner layer is fixed by cooling with the air supplied from cooling fans 12 and 13.

Hereafter, each constitution will be specifically explained.

Heating/pressurizing member 10 will be explained, first.

In heating/pressurizing member 10 shown in FIG. 1, image support material P having an image and transparent toner on its surface is inserted between a pair of rolls 101 and 102 driven at a constant speed to be carried and image support material P is heated and pressurized. Namely, the transparent toner on the image support material P is melted by the heat supplied from heating/pressurizing member 10 and the melted transparent toner can form a transparent toner layer having a smooth and glossy surface by being pressurized. By providing a heat source in the center of one of the pair of rolls 101 and 102, or both, the heat source can heat so that the transparent toner on the image support material is melted. The pair of rolls 101 and 102 preferably have a structure in that the two roll are pushed each other so as the surely pressurize the melted transparent toner between the rolls.

The gloss-providing device 1 shown in FIG. 1 may have a structure in which roll 101 works as a heating roll and roll 102 works as a pressurizing roll, with respect to the electrical consumption and working efficiency, by which sufficient heating and pressurizing are possible. On the surface of one of or both of roll 101 and roll 102 constituting the heating/pressurizing member 10, a silicone rubber or a fluorine containing rubber may be provided, and the width of the nip region where heating and pressurizing are conducted is preferably 1 to 8 mm.

Heating roll 101 has a structure in which an elastic layer containing, for example, a silicone rubber is coated on a surface of a metallic core made of for example, aluminum to have a predetermined outer diameter. In the inside of heating roll 101, for example, a 300 to 350 W halogen lamp is installed as a heat source to heat the heating roll 101 from inside so that the surface temperature reaches the predetermined temperature.

Pressurizing roll 102 has a structure in which an elastic layer containing, for example, a silicone rubber is coated and covered by, for example, a tube of PFA (tetrafluoroethylene/perfluoroalkyl vinylether copolymer) as a separator layer, on a surface of a metallic core made of, for example, aluminum to have a predetermined outer diameter. Also in the inside of pressure roll 102, for example, a 300 to 350 W halogen lamp may be installed as a heat source to heat the pressure roll 102 from inside so that the surface temperature reaches the predetermined temperature.

In the heating/pressurizing member 10, image support material P having an image and transparent toner on its surface is introduced between the rolls which are pushed with each other (nip portion) so that the surface provided with the transparent toner is on the heating roll 101 side, and while it passes through the portion where rolls 101 and 102 are pushed with each other, the transparent toner is melted by the heat and simultaneously fused onto the image to form a transparent toner layer of the predetermined thickness.

Next, the belt member 11 will be explained. As shown in FIG. 1, belt member 11 has an endless belt structure which is supported by heating roll 101 and other plural belts including heating belt 101, namely, rolls 101, 103 and 104, so as to be rotatable. As mentioned above, the belt member 11 is circulatingly set up by plural rolls including heating roll 101, separation roll 103, and driven roll 104, and driven to rotate at a predetermined speed by heating roll 101 which is rotated by a drive source which is not illustrated. Thus, belt member 11 is driven to rotate at a predetermined process speed without wrinkle by the drive forth due to heating roll 101 and a tension provided by separation roll 103 and driven roll 104.

Since the belt member 11 forms a contact surface with the melted transparent toner surface and the image support material P is conveyed through the incited transparent toner surface, it can be produced with a material which possesses a certain extent of heat resistance and mechanical strength. Specifically, for example, heat-resistant film resins such as polyimide, polyether polyimide, PES (polyethersulfone) and PFA (tetrafluoro ethylene/perfluoroalkyl vinylether copolymer) are cited. It is preferable that, a release layer containing a fluorine containing resin such as PTFE (polytetrafluoroethylene) or PFA, or a silicone rubber is formed on at least a surface where the transparent toner layer contacts of the abovementioned heat-resistant film resin.

The thickness of belt member 11 is not specifically limited if the image support material can be conveyed through a contact surface with the melted transparent toner surface, and a belt member with a suitable thickness is usable. Specifically, the thickness of a heat-resistant film resin is preferably 20 to 80 μm, the thickness of a release layer is preferably 10 to 30 μm, and the total thickness is preferably 20 to 110 μm.

Next, cooling fans 12 and 13 will be explained. The gloss-providing device 1 shown in FIG. 1 has cooling fan 12 between heating roll 101 and separation roll 103 in the inside of foregoing belt member 11, and has cooling fan 13 between pressurizing roll 102 on the outside of belt member 11 and conveyance assist roll 14. Here, the outer surface of belt member 11 is a surface which contacts to the image support material, and the image support material P is conveyed while it is contacted to the outer surface of belt member through the melted transparent toner.

In gloss-providing device 1 of FIG. 1, the transparent toner layer is melted by aforementioned heating/pressurizing member 10 and pressed to attain a predetermined thickness. The image support material P is conveyed while the transparent toner layer is adhered on the outer surface of belt member 11, and simultaneously, the transparent toner layer is cooled to solidify. Cooling fans 12 and 13 compulsorily cools the image support material P having the transparent toner layer while being conveyed. Gloss-providing device 1 may be equipped with a heat sink or a heat pipe for cooling in connection with cooling fans 12 and 13. By means of such a heat sink or heat pipe for cooling, the cooling and solidifying the melted transparent toner layer can be promoted.

The solidification of the transparent toner layer of the image support material P under conveyance by the belt member 11 is promoted by forced cooling by the abovementioned cooling fans 12 and 13, and the transparent toner layer is fully cooled and solidified when the transparent toner layer is conveyed near the end where conveyance assist roll 14 and separation rolls 103 are provided. Then, the image support material P is separated from the belt member 11, according to the following procedures.

The image support material P conveyed near the end is conveyed while supported by belt member 11 through the transparent toner layer. In this condition, conveyance assist roll 14 becomes in touch with the back surface of image support material P to assist the conveyance. When image support material P is conveyed to separation roll 103 while supported by conveyance assist roll 14 from backside, belt member 11 changes the conveyance direction toward driven roll 104 (upward in the figure). At this moment, image support material P is separated from belt member 11 according to the stiffness of image support material P itself and discharged from gloss providing device 1 by the conveyance assist roll 14.

According to the abovementioned procedures, gloss providing device 1 heats and pressurizes the image support material having an image and transparent toner to form a melted transparent toner layer having a predetermined thickness, cools and solidifies the transparent toner layer while conveying image support material P on which melted transparent toner layer contacts with the belt member 11. The image support material P is separated from belt member 11 after the transparent toner layer solidifies, and is discharged from the device.

In gloss providing device 1, separation of image support material P from belt member 11 is conducted with the aid of conveyance assist roll 14 and separation roll 103. It is also possible to use a separation claw placed between belt member 11 and image support material P, instead of separation roll 103.

As mentioned above, preparations method of an image on which a transparent toner layer is formed is not specifically limited and images formed by an image forming method such as an electrophotographic method, an inkjet method or a silver-salt photographic method are usable.

Figure 2:
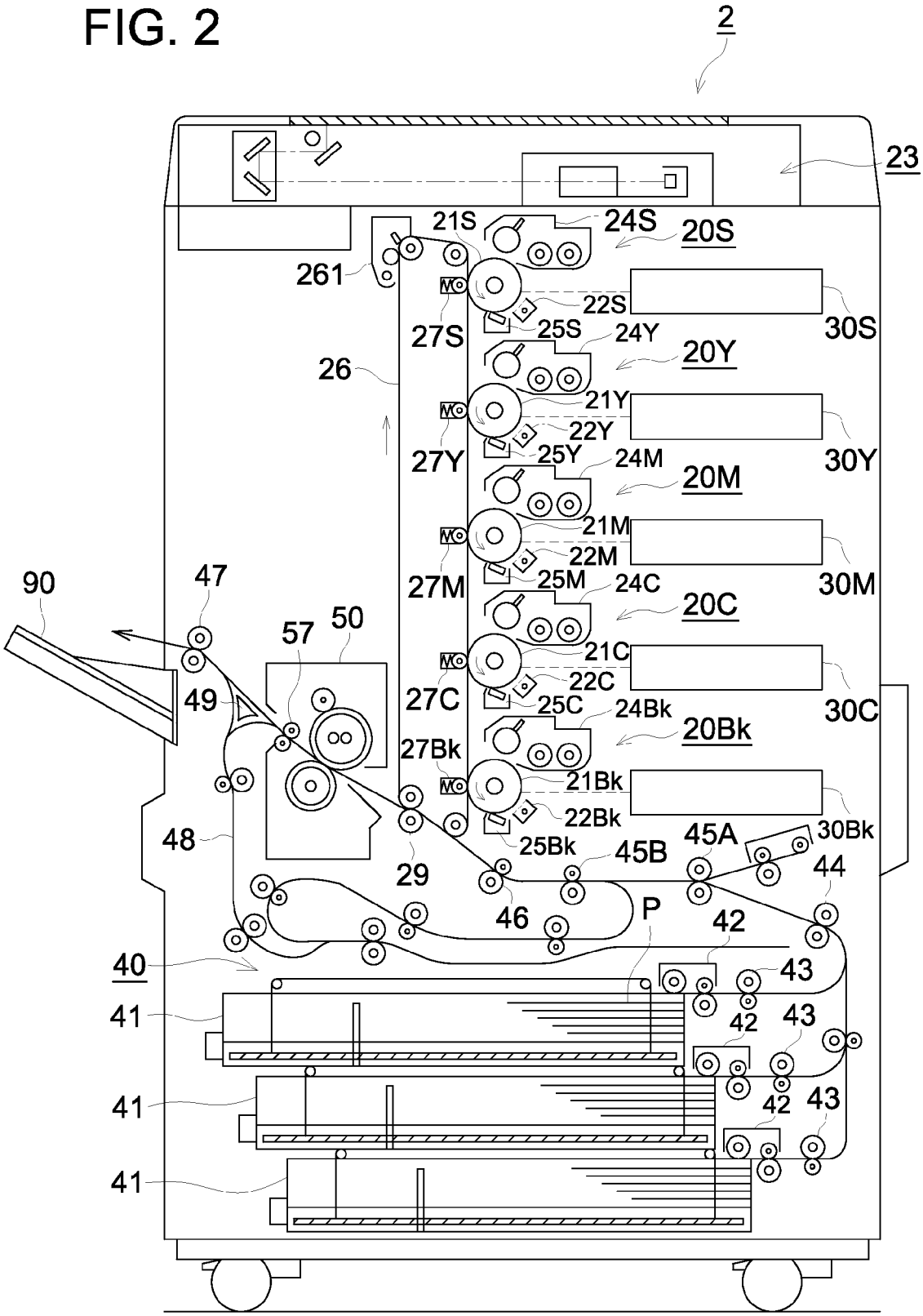
FIG. 2 shows the cross section view of an image forming apparatus for forming a full color toner image and a transparent toner layer on the full color toner image.
Figure 3A:
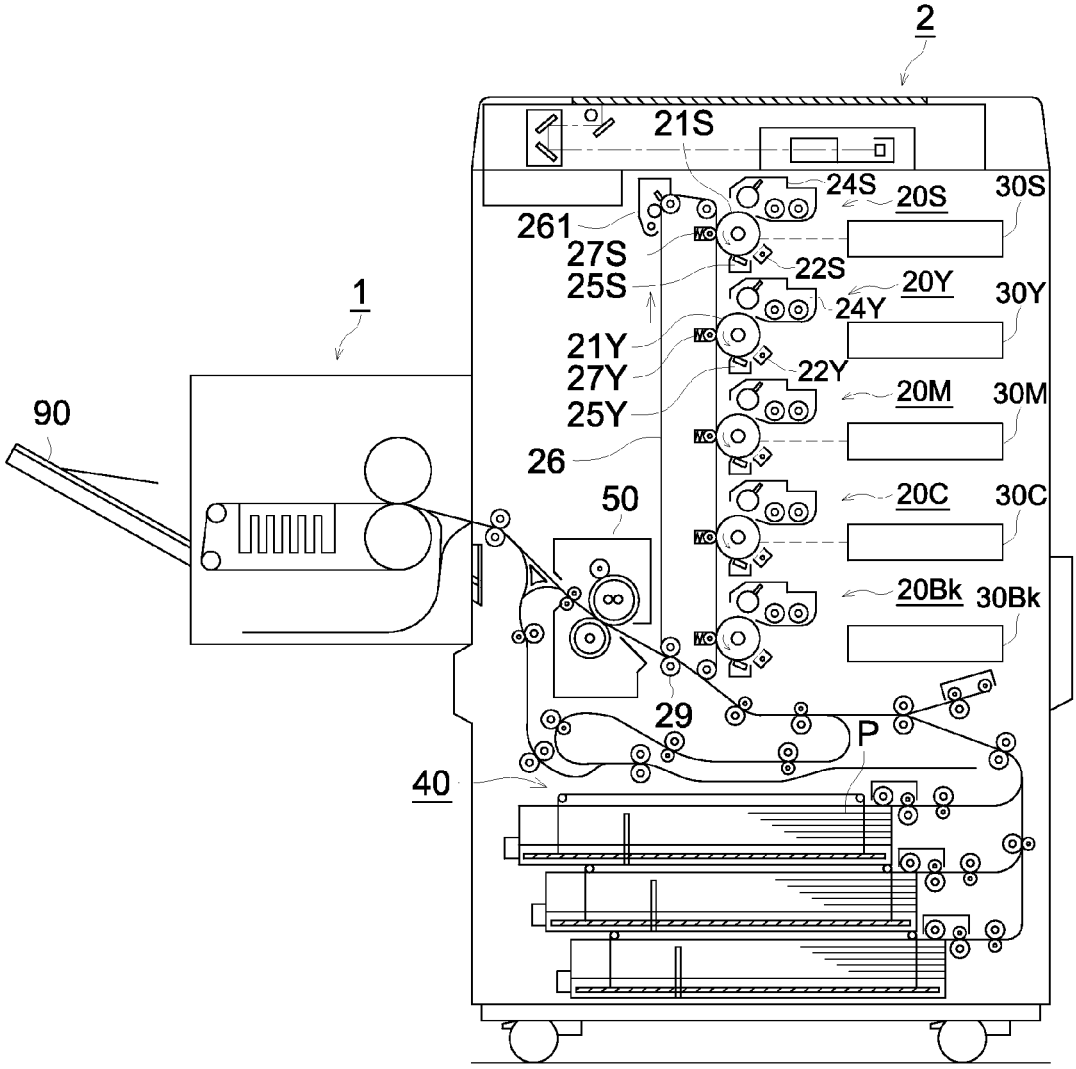
FIG. 3*a* shows the schematic drawing showing an example of an image forming apparatus to which the glossing apparatus is attached.
Figure 3B:
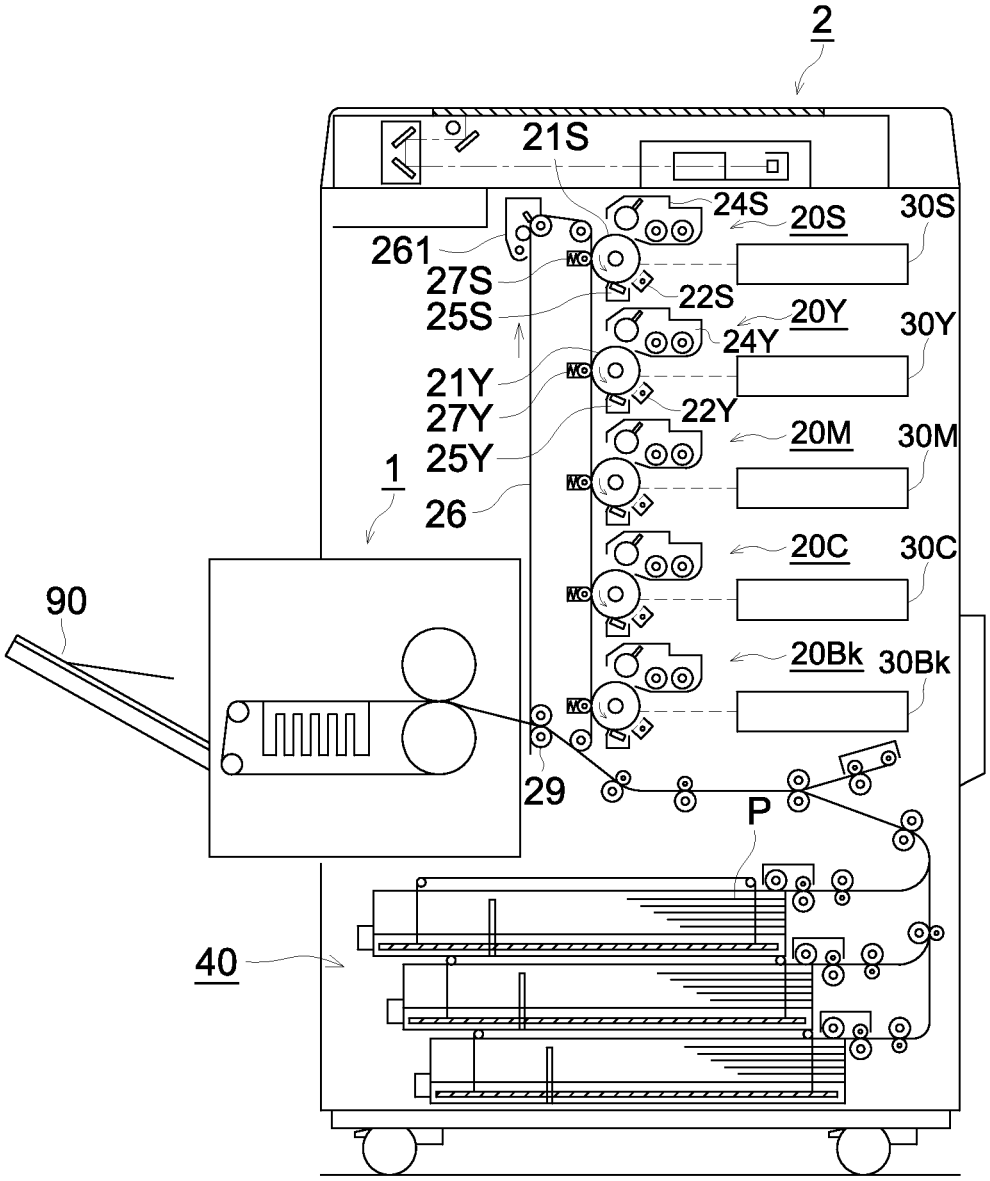
FIG. 3*b* shows the schematic drawing showing an example of an image forming apparatus to which the glossing apparatus is attached.

FIG. 2 is a cross-sectional configuration diagram of an image forming device which forms a full color toner image and also a transparent toner layer on the full color toner image. It is preferable that a gloss providing device 1 is provided in neighborhood of a discharge tray 90 as illustrated in FIG. 3(*a*), in case that a full color image with transparent toner is formed by an apparatus of FIG. 2. In this instance smooth and strong glossy surface is provided on the printed material subjected to fixing process in the apparatus of FIG. 2 whereby photographic print like image can be obtained. Such an image is preferable as an outdoor poster since the fixing strength of the toner image is also increased. Installation of a gloss providing device 1 to image forming apparatus of FIG. 2 will be described by employing FIG. 3(*a*).

Image forming device 2 shown in FIG. 2 is an image forming apparatus having transparent toner layer forming unit 20S added to commonly called as a tandem type color image forming device containing a plurality of toner image forming units 20Y, 20M, 20C and 20Bk, intermediate transfer belt 26, sheet feeder 40 and fixing device 50.

In this specification, in naming a component generically, the reference numerals in which alphabet subscript is omitted are used, and in pointing out discrete components, the reference numerals which is attached with the subscript of S (transparent toner), Y (yellow), M (magenta), C (cyan), and Bk (black) are used.

Transparent toner supply unit 20S which supplies a transparent toner on the image support material, yellow image forming unit 20Y to form a yellow toner image, magenta image forming unit 20M to form a magenta toner image, cyan image forming unit 20C to form a cyan toner image, and black image forming unit 20Bk to form a black toner image, each contain a charging electrode 22 (22S, 22Y, 22M, 22C, 22Bk), an exposing member 30 (30S, 30Y, 30M, 30C, 30Bk), a developing member 24 (24S, 23Y, 24M, 24C, 24Bk) and a cleaning member 25 (25S, 25Y, 25M, 25C, 25Bk) each located around a drum shaped photoreceptor 21 (21S, 21Y, 21M, 21C, 21Bk) as an image carrier.

Image reading device 23 is placed on the upper part of image forming device 2. A manuscript placed on a manuscript holder is image-scanning-exposed to light emitted by an optical system of a manuscript image-scanning exposure device in image reading device 23 to read the image in a line image sensor. The analog signals photo-electric converted by the line image sensor are input to light exposure devices 30Y, 30M, 30C and 30Bk, after conducting analog processing, A/D conversion, a shading correction and image compression processing in control section. Signals to supply the clean toner is input to light exposure device 30S according to desirable areas for forming gloss surface such as an image as obtained by scanning. This image to form the gloss surface may be a part of or a whole part of the image support material.

Photoreceptor 21 contains an organic photoreceptor in which a photoreceptor layer containing a resin in which an organic photoconductor is incorporated is formed on a peripheral surface of a drum shaped metal support, which is placed extending toward the width direction of image support material P (a direction perpendicular to the paper sheet in FIG. 2). As a resin for the photoreceptor layer formation, a resin for forming a photoreceptor layer such as polycarbonate is used. In the embodiment shown in FIG. 2, an example in which a drum shaped photoreceptor 21 is used, however, the photoreceptor is not limited thereto and a belt shaped photoreceptor may be used.

Developing member 24 each include a two-component developer containing each of a transparent toner according to the present invention (S), a yellow toner (Y), a magenta toner (M), a cyan toner (C), and a black toner (Bk), and a carrier. A two-component developer is constituted of color toners of each color each containing a carrier having ferrite particles on which an insulating resin is coated, a colorant such as a binder resin, a pigment or carbon black, a charge control agent, silica, or titanium oxide.

As for a carrier, the average particle diameter is 10 to 50 μm and the saturation magnetization is 10 to 80 emu/g. The average particle diameter of the toner is 4 to 10 μm. The electrification characteristic of the toner used in the image forming device shown in FIG. 2 including the transparent toner according to the present invention is preferably negative electrification characteristic and the amount of average electric charge is preferably −20 to −60 mC/g. The mixing ratio of the toner and the carrier in a two-component developer is adjusted so that the content of the toner is 4 to 10% by mass.

Intermediate transfer belt 26 which is an intermediate transfer medium is circulatingly supported by plural rolls. Intermediate transfer belt 26 is an endless belt exhibiting a volume resistance of preferably $10^6$-$10^{12}$ Ω·cm. Intermediate transfer belt 26 may be formed by a resin, for example, polycarbonate (PC), polyimide (PD, polyamideimide (PAD, polyvinylidene fluoride (PVDF), or a tetrafluoroethylene-ethylene copolymer (ETFE). The thickness of intermediate transfer belt 26 is preferably 50-200 μm.

Each color image formed on each photoreceptor 21 (21S, 21Y, 21M, 21C, 21Bk) by each of transparent toner image forming unit 20S, and toner image forming units 20Y, 20M, and 20C is sequentially transferred on to intermediate transfer belt 26 employing primary each transfer roller 27 (27S, 27Y, 27M, 27C, and 27Bk) (primary transfer), whereby a transparent toner image and a combined full color image is formed. After the images are transferred, each photoreceptor of 21Y, 21M, 21C and 21Bk is subjected to cleaning by each cleaning member 25 (25S, 25Y, 25M, 25C, 25Bk) to remove residual toner.

Image support material P stored in storing member (tray) 41 in sheet feeder 40 is fed to first feeding member 42 and conveyed through feeding rolls 43, 44, 45A, 45B, and resist roll 46 (second feeding member) to secondary transfer roll 29, where the transparent toner image and the full color image are transferred (secondary transfer).

The three vertically arrayed storing members 41 in the lower portion of image forming device 2 were provided with the same number since these three members have almost the same structure. Also, the three vertically arrayed feeding members 42 were provided with the same number since the structures are almost the same. Storing members 41 and feeding members 42 in all are named as sheet feeder 40.

The transparent toner image and the full color image transferred on image support material P are fixed on image support material P by fixing unit 50 which enables heating and pressurizing the toner to melt and solidify in the same manner as in gloss providing device 1 in FIG. 1, although the structure is different. Image support material P is conveyed between a pair of conveying rolls 57, discharged through discharge rolls 47, and placed on a discharge tray 90 which is outside of the image forming device.

After transferring the transparent toner layer and the full color toner image onto image support material P using secondary transfer roll 29 and separating image support material P by curvature separation, the residual toner is removed by cleaning member 261 for the intermediate transfer belt.

When a full color image having full color images on both surfaces of image support material P each having a transparent toner layer is formed, image support material P is branched from the conveyance pass for discharging by branching plate 49, after the transparent toner layer and the full color image formed on the first side surface of image support material P are subjected to the melt/solidify treatment, to introduce into double surface conveyance pass 48 to convert the front side and the rear side and then conveyed again through feed roll 45B. Also on the second surface, a transparent toner layer and full color images containing each color are formed using transparent toner layer forming unit 20S and image forming unit of each color 20Y, 20M, 20C and 20Bk, followed by being subjected to a heating/pressurizing treatment using fixing unit 1 and discharging out of the image forming device using discharging rolls 47. Thus, full color toner images having transparent toner on both surfaces of each of which, gloss is provided by forming transparent toner layers.

As mentioned above, a full color image having a transparent toner layer on image support material P can be formed using the image forming device shown in FIG. 2.

In the present invention, gloss providing device 1 can be arranged to the image fanning device 2 of FIG. 2, in the manner as shown in FIGS. 3(*a*) and 3(*b*). Here, FIGS. 3(*a*) and 3(*b*) are schematic diagrams showing examples of a device in which a gloss providing device is installed in the image fanning device of FIG. 2. In FIG. 3(*a*), illustrated is a image forming device in which gloss providing device 1 is installed at the position of discharging member 90 of image forming device 2, in which an image print P fixed in fixing member 50 installed in image forming device 2 is further treated in gloss providing device 1 to further fix the transparent toner layer, whereby a flat and glossy transparent toner layer also having stiffness can be provided. Such an image is preferable as an outdoor poster since the fixing strength of the toner image is also increased.

In FIG. 3(*b*), illustrated is an image forming device in which gloss providing device 1 is installed at the position of fixing device 50 of FIG. 2, in which the transparent toner layer transferred on image support material P by secondary transfer roll 29 and the full color toner image are simultaneously fixed by gloss providing device 1. The image forming device shown in FIG. 3(*b*) is preferable because gloss providing device 1 is installed inside the device, whereby a compact device is achieved.

The image support material which can form a glossy image employing the transparent toner according to the present invention is not specifically limited, if image is formed and maintains the transparent toner layer. As the image support material usable in the present invention, materials, for example, a regular paper from a thin paper to a thick paper, a fine quality paper, and an art paper, a printing paper, such as a coated paper, a commercial Japanese paper, a plastic film for an over head projector and a cloth are cited.

EXAMPLES

The embodiments of the invention are concretely described below referring examples, though the invention is not limited to the examples. In the description, "part" means "part by weight".

1. Preparation of Transparent Toners 1 to 16

Sixteen kinds of transparent toners, Transparent toners 1 to 16, were prepared in the following manner.

1-1. Preparation of Resin Particles 1 to 6

(1) Preparation of Dispersion of Resin Particle 1

The following mixture of polymerizable monomers was heated by 95° C. and added to 240 parts by weight of water containing 3 parts by weight of an anionic surfactant (sodium dodecyl-benzenesulfonate), and then the mixture was dispersed by a ultrasonic dispersing machine for forming droplets to prepare a reacting liquid. The polymerizable monomers constituting the mixture were as follows:

| | |
|---|---|
| Polyoxyethylene(2,2)-2,2-bis(4-hydroxyphenyl)propane | 22 parts by weight |
| Neopentyl glycol | 1.2 parts by weight |
| Terephthalic acid | 10 parts by weight |
| Isophthalic acid | 0.6 parts by weight |
| Styrene | 80 parts by weight |
| 2-ethylhexyl acrylate | 20 parts by weight |

The reacting liquid was made react at 97° C. for 50 hours to form a polyester resin having a weight average molecular weight of 60,000. An then, the temperature of the reacting liquid was lowered by 80° C., and an aqueous solution prepare by dissolving 0.84 parts by weight of potassium persulfate (KPS) and 1.0 part by weight of 2-chloroethanol in 240 parts by weight of deionized water was added, and then stirred for 3 hours at 80° C. for making radical polymerization reaction. After that, the reacting liquid was cooled by 40° C. to obtain styrene-acryl resin.

A dispersion of Resin Particle 1 composed of polyester and styrene-acryl type copolymer and having peaks of weight average molecular weight at 60,000 and 20,000 was prepared by the above-mentioned procedure.

(2) Preparation of Dispersion of Resin Particle 2

A dispersion of Resin Particle 2 composed of polyester and styrene-acryl type copolymer and having two peaks of weight average molecular weight at 40,000 and 10,000 was prepared in the same manner as in the dispersion of Resin Particle 1 except that the timer for the first polymerization reaction carried out at 97° C. was shortened by 30 hours and the amounts of potassium persulfate (KPS) and 2-chloroethanol to be used in the second polymerization reaction were each varied to 1.50 parts by weight and 1.80 parts by weight, respectively.

(3) Preparation of Dispersion of Resin Particle 3

A dispersion of Resin Particle 3 composed of polyester and styrene-acryl type copolymer and having two peaks of weight average molecular weight at 100,000 and 30,000 was prepared in the same manner as in the dispersion of Resin Particle 1 except that the timer for the first polymerization reaction carried out at 97° C. was prolonged by 90 hours and the amounts of potassium persulfate (KPS) and 2-chloroethanol to be used in the second polymerization reaction were each varied to 0.56 parts by weight and 0.65 parts by weight, respectively.

(4) Preparation of Dispersion of Resin Particle 4

A dispersion of Resin Particle 4 composed of polyester and styrene-acryl type copolymer and having two peaks of weight average molecular weight at 30,000 and 8,000 was prepared in the same manner as in the dispersion of Resin Particle 1 except that the timer for the first polymerization reaction carried out at 97° C. was shortened by 20 hours and the amounts of potassium persulfate (KPS) and 2-chloroethanol to be used in the second polymerization reaction were each varied to 1.850 parts by weight and 2.20 parts by weight, respectively.

(5) Preparation of Dispersion of Resin Particle 5

A group of the following compounds was prepared:

| | |
|---|---|
| Adduct of Bisphenol A and propylene oxide (average additional mole number: 2.2) | 140 parts by weight |
| Adduct of Bisphenol A and ethylene oxide (average additional mole number: 2) | 70 parts by weight |
| Dimethyl isophthalate | 30 parts by weight |
| Terephthalic acid | 50 parts by weight |
| Dodecenylsuccinic acid | 50 parts by weight |

The above Compound Group A and 0.12 parts by weight of a catalyst of dibutyl tin oxide were put into a dried three-mouthed flask. The air pressure in the flask was reduced and inactive atmosphere was made by nitrogen gas. The contents of the flask were refluxed for 10 hours at 180° C. while mechanically stirring. After that, stirring was continued for 10 hours while the temperature was gradually raised by 200° C. by reduced pressure distillation. The molecular weight was measured by GPC when the reacting liquid was made viscous. The reduced pressured distillation was stopped when the weight average molecular weight was reached to 40,000 and cooled by air to prepare Polyester Resin.

The above Polyester Resin in the molten state was transferred into Cabitron CD1010, manufactured by EuroTec Co. Ltd., at a rate of 100 g per minute. Diluted ammonia water having a concentration of 0.37% by weight prepared by diluting reagent class ammonia water by deionized water was poured into a separately prepared aqueous medium tank and heated by 120° C. by a heat exchanger. The diluted ammonia water was transferred into the Cabitron at a rate of 0.1 liter per minute simultaneously with the foregoing crystalline polyester resin. In such the state, Cabitron was driven to prepare a dispersion of Resin Particle 5 composed of polyester resin only. On this occasion, the rotating frequency of the rotor and the pressure were each controlled at 60 Hz and $4.9\times10^5$ Pa, respectively.

(6) Preparation of Dispersion of Resin Particle 6

The following compounds were put into a flask on which a stirring device was attached and dissolved to prepare a mixed liquid and heated by 80° C.

| | |
|---|---|
| Styrene | 125 parts by weight |
| n-Butyl acrylate | 47 parts by weight |
| Methacrylic acid | 11 parts by weight |

Besides, a surfactant solution prepared by dissolving 7.2 parts by weight of an anionic surfactant (sodium benzenesulfonate) in 2,760 parts by weight of deionized water was charged into a separable flask on which a stirrer, thermal sensor, cooling tube and nitrogen gas introducing device were attached, and the temperature was raised by 80° C. while stirring at a rate of 230 rpm under nitrogen gas stream. Then the foregoing mixed liquid (80° C.) was added to the surfactant solution and dispersed by a dispersing apparatus CLEARMIX, manufactured by M-Tec Co., Ltd., having a circulation pass to prepare an emulsion in which emulsified particles (oil droplets) having uniform dispersed particle diameter were dispersed.

To the dispersion, an initiator solution prepared by dissolving 0.9 parts by weight of the polymerization initiator (potassium per sulfate: KPS) in 200 parts by weight of deionized water was added, and the resulted system was heated and stirred for 3 hours at 80° C. to make the polymerization reaction. To the obtained reacting liquid, a solution prepared by dissolving 7.4 parts by weight of the polymerization initiator (KPS) in 240 parts by weight of deionized water was added. After 15 minutes the temperature was raised by 80° C. and then a mixture solution composed of the following compounds was dropped spending 100 minutes.

| | |
|---|---|
| Styrene | 395 parts by weight |
| n-Butyl acrylate | 140 parts by weight |
| Methacrylic acid | 45 parts by weight |
| n-Octyl mercaptan | 12 parts by weight |

The system was heated and stirred at 80° C. for 60 minutes and then cooled by 40° C. do as to prepare a dispersion of Resin. Particle 6 solely composed of styrene-acryl type copolymer. The weight average molecular weight of thus obtained Resin Particle 6 has peaks at 28,000 and 14,000.

1-2. Preparation of Monoester Compound/Hydrocarbon Particles 1 to 15

(1) Preparation of Dispersion of Monoester Compound/Hydrocarbon Particle 1

To 30 parts by weight of deionized water, 1.0 part by weight of the anionic surfactant (sodium dodecylbenzenesulfonate: SDS) was added, dissolved and stirred to prepare a surfactant aqueous solution. To the surfactant aqueous solution, a mixture prepared by dissolving the following compounds by heating at 90° C. was gradually added:

| | |
|---|---|
| Monoester compound (1-6) ($CH_3$—$(CH_2)_{20}$—COO—$(CH_2)_{21}$—$CH_3$) | 65 parts by weight |
| Microcrystalline wax, HNP-0190 manufactured by Nippon Seiro Co., Ltd. | 7 parts by weight |

The surfactant solution containing the above mixture was heated by 80° C. and subjected to a dispersing treatment for 1 hour by using the mechanical disperser having the circulating pass, CLEARMIX manufactured by M-Tec Co., Ltd., at a rotation rate of 18,000 rpm to prepare a dispersion of Monoester Compound/Hydrocarbon Particles 1. It was confirmed by the foregoing $^{13}$C-NMR measurement that the microcrystalline wax has the branched chain structure and the cyclic structure in the molecular structure thereof.

(2) Preparation of Monoester Compound/Hydrocarbon Compound Particles 2 to 15

Monoester compound/Hydrocarbon Compound Particles 2 to 15 were prepared in the same manner as in Monoester compound/Hydrocarbon Compound Particle 1 except that the monoester compound and the hydrocarbon compound use for preparing Monoester Compound/Hydrocarbon Compound Particle 1 were changed by the compounds shown in Table 1. The "carbon number" of the monoester compound shown in Table 1 represents the number of the carbon atoms of hydrocarbon group $R^1$ and $R^2$ constituting the monoester compound represented by the formula of $R^1$—COO—$R^2$. For example, "21-22" described in the column of carbon number of Monoester Compound 1-6 means that the compound is constituted by a hydrocarbon group $R^1$ having 21 carbon atoms and a hydrocarbon group $R^2$ having 22 carbon atoms.

Compounds CC-1 and CC-2 to be used as comparative compounds shown in Table 1 were the compounds each having the following structure.

$$CH_3—(CH_2)_8—COO—(CH_2)_9—CH_3 \quad \text{CC-1:}$$

$$CH_3—(CH_2)_{32}—COO—(CH_2)_{33}—CH_3 \quad \text{CC-2:}$$

In Table 1, ones using isoparaffin wax as the hydrocarbon compound are contained; it was confirmed by the foregoing $^{13}$C-NMR measurement that the isoparaffin wax has the branched chain structure in the molecular structure thereof.

1-3. Preparation of Transparent Toners 1 to 15

(1) Preparation of Transparent Toner 1

The following compositions were charged and stirred in a reaction vessel on which a stirrer, thermal sensor, cooling tube and nitrogen introducing device were attached.

| | | |
|---|---|---|
| Resin Particle 1 | 1,400 | parts by weight in terms of solid ingredient |
| Monoester compound/hydrocarbon Particle 1 | 10 | parts by weight in terms of solid ingredient |
| Deionized water | 2,000 | parts by weight |

The temperature was controlled at 30° C. and then a 5 mole/l sodium hydroxide solution was added to adjust the pH to 10.

After that, an aqueous solution prepared by dissolving 35 parts by weight of magnesium chloride hexahydrate in 35 parts by weight of deionized water was added spending 10 minutes at 30° C. while stirring. After standing for 3 minutes, the temperature was raised by 90° C. spending 60 minutes, and the coagulation and fusion of the above particles were continued while keeping the temperature at 90° C. In such the state, the diameter of the particles obtained by the coagulation and fusion was measured by Multisizer 3, manufactured by Beckman Coulter Inc. The coagulation of the particles was stopped by adding an aqueous solution prepared by dissolving 150 parts by weight of sodium chloride in 600 parts by weight of deionized water when the volume based median diameter of the particles was reached to 5.5 μm.

After stop of the coagulation, the particles were ripened at a liquid temperature of 98° C. while heating and stirring, and the average circularity of the particles was measured by PPIA-2100, manufactured by Sysmex Corp. The fusing was continued until the average circularity reached to 0.965 to form Transparent toner Mother Particle 1. After that, the liquid temperature was cooled by 30° C. and the pH was adjusted to 2 by using hydrochloric acid, and then stirring was stopped.

The solid ingredient of the above prepared Transparent toner Mother Particle Dispersion 1 was separated from the liquid ingredient by a basket type centrifuge separator Mark II 60×40, manufactured by Matsumoto Machine Mfg. Co., Ltd., to prepare a wet cake of Transparent toner Mother Particle 1. The wet cake was washed by deionized water of 45° C. by using the foregoing centrifuge separator until the electric conductivity of the filtrate became to 5 ηS/cm, and then transferred to Flash Jet Dryer, manufactured by Seishin Enterprise Co., Ltd., and dried until the moisture content was reduced by 0.5% by weight to prepare Transparent toner Mother Particle 1.

(2) Addition of External Additives

The following external additives were added to the above prepared Transparent toner Mother Particle 1 and treated by Henschel Mixer, manufactured by Mitsui Miike Mining Co., Ltd., to prepare Transparent toner 1.

| | |
|---|---|
| Hexamethylsilazane-treated Silica (Average primary particle diameter: 12 nm) | 1.0 part by weight |
| n-octylsilane-treated titanium dioxide (Average primary particle diameter: 20 nm) | 0.3 parts by weight |

The treatment by Henschel mixer was carried out for 15 minutes at a circumference speed of the stirring wing of 35 m/sec and a treatment temperature of 35° C.

(3) Preparation of Transparent Toners 2 to 15

Transparent toners 2 to 15 were prepared in the same manner as in Transparent toner 1 except that Resin Particle 1 and Monoester Compound/Hydrocarbon Compound Particle 1 were each replaced by Resin Particles and Monoester Compound/Hydrocarbon Compound Particles shown in Table 1, respectively.

Details of Resin Particles and Monoester Compound/Hydrocarbon Compound Particles used in the preparation of Transparent toners 1 to 15 are listed in the following Table 1.

TABLE 1

| | Resin Particle | | | Monoester Compound/Hydrocarbon Compound Particle | | | | | |
|---|---|---|---|---|---|---|---|---|---|
| Transparent Toner No. | No. | Position of peak of molecular weight | | No. | Kind and carbon atom number of monoester compound | | Kind of hydrocarbon compound | Branched chain structure | Cyclic structure |
| 1 | 1 | 60,000 | 20,000 | 1 | 1-6 | 21-22 | Microcrystalline wax | Yes | Yes |
| 2 | 4 | 30,000 | 8,000 | 2 | 1-1 | 13-14 | Isoparaffin | Yes | None |
| 3 | 4 | 30,000 | 8,000 | 3 | 1-8 | 29-30 | Microcrystalline wax | Yes | Yes |
| 4 | 1 | 60,000 | 20,000 | 4 | 1-9 | 13-13 | Microcrystalline wax | Yes | Yes |
| 5 | 1 | 60,000 | 20,000 | 5 | 1-12 | 30-30 | Microcrystalline wax | Yes | Yes |
| 6 | 2 | 40,000 | 10,000 | 6 | 1-3 | 17-18 | Microcrystalline wax | Yes | Yes |
| 7 | 3 | 100,000 | 30,000 | 7 | 1-4 | 17-22 | Isoparaffin | Yes | None |
| 8 | 2 | 40,000 | 10,000 | 8 | 1-6 | 21-22 | Microcrystalline wax | Yes | Yes |
| 9 | 3 | 100,000 | 30,000 | 9 | 1-6 | 21-22 | Microcrystalline wax | Yes | Yes |
| 10 | 5 | 40,000 | — | 10 | 1-6 | 21-22 | Microcrystalline wax | Yes | Yes |
| 11 | 6 | 28,000 | 14,000 | 11 | 1-6 | 21-22 | Microcrystalline wax | Yes | Yes |
| 12 | 5 | 40,000 | — | 12 | 1-6 | 21-22 | — | — | — |
| 13 | 6 | 28,000 | 14,000 | 13 | — | — | Microcrystalline wax | Yes | Yes |
| 14 | 4 | 30,000 | 8,000 | 14 | CC-1 | 9-10 | Microcrystalline wax | Yes | Yes |
| 15 | 1 | 60,000 | 20,000 | 15 | CC-2 | 33-34 | Microcrystalline wax | Yes | Yes |

Carbon atom number: Number of carbon atoms of each of $R^1$ and $R^2$ in the monoester compound ($R^1$—COO—$R^2$)

1-4. Preparation of Transparent Toner 16

The transparent toner disclosed in JP-A2002-341619 (Patent Document 2) was prepared by the following procedure. Namely, the following compounds were sufficiently mixed by Henschel Mixer, manufactured by Mitsui Miike Mining Co., Ltd., and melted and kneaded by a biaxial extruding kneader PCM-30, manufactured by Ikegai Corp., from which the taking out parts was detached, and then cooled.

| | |
|---|---|
| Polyester resin (linear polyester resin produced from terephthalic acid/adduct of bisphenol A and ethylene oxide/cyclohexane dimethanol in a mole ratio of 5:4:1) | 100 parts by weight |

-continued

| | |
|---|---|
| Pentaerythritol behenate | 6 parts by weight |
| Charge controlling agent (boron dibenzylate) | 1 part by weight |

The obtained kneaded material was cooled on a cooling belt and roughly crushed by a feather mill, and further crushed by a mechanical crusher TMK, manufactured by Kawasaki Heavy Industries Ltd., until the average particle diameter was made to 9 to 10 μm. Moreover the crushed material was powdered and roughly classified by a jet crusher IDS, manufactured by Nippon Pneumatic Mfg. Co., Ltd., until the average particle diameter was made to 5.5 μm. Transparent toner Mother Particle 16 having a volume based median diameter of 5.5 μm was prepared from the above roughly classified powder by using a rotor type classifying apparatus (Teaplex type separator 100ATP manufactured by Hosokawa Micron Corp.).

The following external additives were added to the above prepared Transparent toner Mother Particle 16 and treated by Henschel Mixer, manufactured by Mitsui Miike Mining Co., Ltd., to prepare Transparent toner 1.

| | |
|---|---|
| Hexamethylsilazane-treated Silica (Average primary particle diameter: 12 nm) | 1.0 part by weight |
| n-Octylsilane-treated titanium dioxide (Average primary particle diameter: 20 nm) | 0.3 parts by weight |

The treatment by Henschel mixer was carried out for 15 minutes at a circumference speed of the stiffing wing of 35 msec and a treatment temperature of 35° C.

Transparent toners 1 to 16 were prepared in the above manner.

2. Evaluation Experiment 2-1. Preparation of Transparent Toner Developers 1 to 16

Ferrite carrier coated with methyl methacrylate resin having a volume average particle diameter of 40 μm was mixed with each of Transparent toners 1 to 16 so as to make the transparent toner concentration to 6% by weight to prepare two-component Transparent toner Developers 1 to 16.

2-2. Evaluation Experiment (1) Evaluation Conditions

Transparent toners 1 to 16 were each charged into the glossing apparatus 1 shown in FIG. 1. The operating conditions of the glossing apparatus were set as later-mentioned for forming the transparent toner layer on the whole surface of the image supports each carrying the same image printed by various image forming apparatuses available on the market OK Top Coat+Paper (weight: 157 g/m$^2$, thickness: 131 μm) manufactured by Oji Paper Co., Ltd., was used as the image support. The following image forming apparatuses (a) to (c) available on the market were used for printing the images. Thirty thousand sheets of image support for evaluation were printed by each of the image forming apparatuses, and the glossing apparatus was continuously driven for 90,000 sheets in total. The evaluation carried out by using the Transparent toners 1 to 9 satisfying the constitution of the invention were r each referred to as Examples 1 to 9, and that using Transparent toners 10 to 16 without the invention were each referred to as Comparative Examples 1 to 7, respectively.

The image forming apparatuses used for the evaluation were as follows:

(a) Electrophotographic system: bizhub C353CS (Konica Minolta Business Technologies Inc.)

(b) Ink-jet system: Ink jet Printer PX-5800 (Seiko Epson Corp.)

(c) Press Work system: RISO Digital Screen plate making machine SP400D (Riso Kagaku Corp.)

In the course of continuous operation of the glossing apparatus 1, the printed matters were continuously supplied one by one to the glossing apparatus 1 so that the transparent toner layer was formed on each of the printed matters prepared by each of the image forming apparatuses. The description of "the printed matters prepared by each of the image forming apparatuses were continuously supplied one by one" means that, for example, the printed matters were lined in the order of the image of electrophotography→the image of ink jet→the image of press work.

The conditions of glossing apparatus 1 shown in FIG. 1 were as follows:

(a) Transparent toner amount to be used for development: 4 g/m$^2$ (b) Material of the belt: Polyimide film (thickness: 50 μm) with PFA layer (thickness: 10 μm)

(c) Toughness of belt surface: 0.4 μm in Ra (d) Specification of heating and pressing roller Heating roller: Aluminum substrate having an outer diameter of 100 mm and a thickness of 10 mm Pressing roller: Aluminum substrate having an outer diameter of 80 mm and a thickness of 10 mm covered with a silicone rubber layer of 3 mm A halogen lump was provided inside of each of the heating and pressing rollers and the surface temperature of the heating roller and that of the pressing roller were each controlled by thermistor at 155° C. and 115° C., respectively.

Nipping width between the heating roller and the pressing roller: 11, mm (e) Temperature of the image support at the position of the releasing roller: set at 50±5° C.

(f) Distance from the nipping portion to the position of releasing roller: 620 mm (g) Transferring rate of the image support: 220 mm/second (h) Transferring direction of the image support: A3 size of image support was transferred in the length direction.

(i) Evaluation environment: Ordinary temperature and humidity (20° C., 50% RH)

(2) Evaluation Item

The degradation appearance of the belt surface was visually evaluated at the initial time, after treatments of about 60,000 sheets and the final time in the course of the continuous operation of 90,000 sheets by the glossing apparatus 1 of FIG. 1, and the glossiness of the transparent toner layer surface formed on the images printed by each of the image forming apparatuses was quantitatively evaluated by the image mirroring ability and qualitatively evaluated by visual observation.

(Degradation State of the Belt Surface)

A: The presence of cracks or flaws could not be confirmed by both of the visual observation and touching sense of the forefinger.

B: The presence of small cracks or flaws was confirmed by touching by the forefinger though could not be visually confirmed.

C: The presence of cracks or flaws was confirmed by visual observation.

As shown in Table 2, the progression of degradation of the belt surface accompanied with the continuous operation of 90,000 sheets in Examples 1 to 9 and that in Comparative Examples 1 to 7 were the same.

Figure 4:
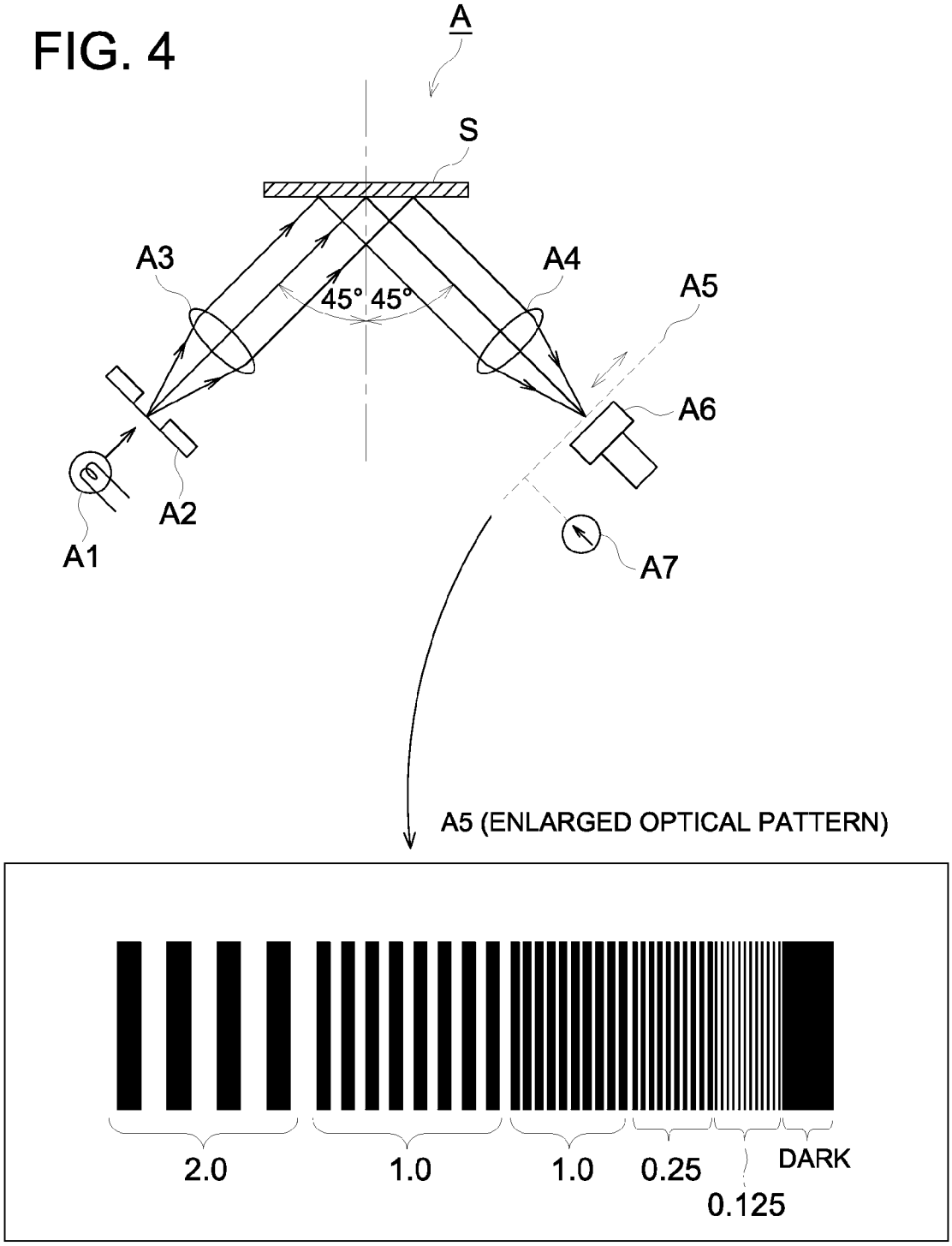
FIG. 4 shows the schematic drawing showing the principle of measuring the image mirroring ability value C by TM type image reflectivity measuring apparatus.

The "image mirroring ability" was evaluated by the following procedure. The image mirroring ability" is one of the methods for evaluation the glossiness, in which degree of the sharpness and distortion of image mirrored on the transparent toner layer surface by light is quantitatively evaluated. In concrete, the evaluation was according to a value defined by the percentage so called as image mirroring ability value C measured by a measuring apparatus so called as a TM type image mirroring ability measuring apparatus. Larger value of the image mirroring ability value C corresponds to higher glossiness. The principle of the measurement of image mirroring ability value C by the TM type image mirroring ability measuring apparatus is shown in FIG. 4. In FIG. 4, A is the TM type image mirroring ability measuring apparatus, A1 is a lump, A2 is a slit, A3 is a collimator lens, A4 is an image focusing lens, A5 is an image pattern (optical comb), A6 is a light receiving device, A7 is a motor and S is a sample.

In this evaluation, the image mirroring ability value C of image of an optical comb having a width of 2 mm mirrored on the transparent toner layer, which was formed on the image formed on the image support by the foregoing image forming apparatus, was calculated for evaluation. In concrete, the image mirroring ability value C at 45° was measured and calculated by a TM type image mirroring ability measuring apparatus available on the market as ICM-1T, manufactured by using Suga Test Instruments Co., Ltd., at a measuring angle of 45° and using an optical comb with a width of 2 mm, and the evaluation was carried out according to the following norms. The TM type image mirroring ability measuring apparatus used for the measurement had a measuring hole size of 20 mm and a power source with a capacity of single phase 100 V and 2 A. The measured results were calibrated by using a black glass plate Optic Standards (reflection measurement 45°/60°), manufactured by Suga Test Instrument Co., Ltd., as the standard plate for maintaining the measuring apparatus.

The samples having an image mirroring ability value C of not less than 40 was evaluated as acceptable and those having the value of not less than 70 was evaluated as excellent. The samples having the value of from 60 to 70 were evaluated as suitable.

Test results are listed in Table 2.

TABLE 2

| | | Degraded condition of belt surface | | | Evaluation results of image mirroring ability | | | | | | | | |
|---|---|---|---|---|---|---|---|---|---|---|---|---|---|
| | | | | | Electrophotographic image | | | Ink-jet image | | | Printing work image | | |
| | Transparent Toner No. | Initial time | After about 30,000 sheets | After about 90,000 sheets | Initial time | After about 30,000 sheets | After about 90,000 sheets | Initial time | After about 30,000 sheets | After about 90,000 sheets | Initial time | After about 30,000 sheets | After about 90,000 sheets |
| Example 1 | 1 | A | B | C | 75 | 74 | 74 | 76 | 75 | 74 | 75 | 75 | 74 |
| Example 2 | 2 | A | B | C | 73 | 69 | 58 | 74 | 68 | 57 | 74 | 68 | 56 |
| Example 3 | 3 | A | B | C | 74 | 68 | 57 | 73 | 67 | 56 | 74 | 66 | 57 |
| Example 4 | 4 | A | B | C | 74 | 71 | 68 | 74 | 72 | 67 | 74 | 72 | 68 |
| Example 5 | 5 | A | B | C | 75 | 70 | 66 | 74 | 70 | 66 | 73 | 70 | 67 |
| Example 6 | 6 | A | B | C | 76 | 75 | 74 | 75 | 75 | 74 | 76 | 75 | 75 |
| Example 7 | 7 | A | B | C | 75 | 74 | 73 | 75 | 75 | 73 | 75 | 76 | 74 |
| Example 8 | 8 | A | B | C | 74 | 74 | 72 | 75 | 74 | 72 | 74 | 73 | 72 |
| Example 9 | 9 | A | B | C | 75 | 75 | 74 | 76 | 75 | 74 | 74 | 73 | 73 |
| Comparative Example 1 | 10 | A | B | C | 70 | 36 | 29 | 71 | 35 | 27 | 70 | 37 | 28 |
| Comparative Example 2 | 11 | A | B | C | 69 | 35 | 28 | 70 | 35 | 29 | 71 | 35 | 30 |
| Comparative Example 3 | 12 | A | B | C | 71 | 31 | 23 | 70 | 31 | 22 | 70 | 31 | 24 |
| Comparative Example 4 | 13 | A | B | C | 72 | 30 | 21 | 69 | 31 | 22 | 71 | 29 | 23 |
| Comparative Example 5 | 14 | A | B | C | 71 | 35 | 30 | 70 | 36 | 28 | 70 | 37 | 29 |
| Comparative Example 6 | 15 | A | B | C | 70 | 43 | 38 | 71 | 44 | 37 | 58 | 40 | 37 |
| Comparative Example 7 | 16 | A | B | C | 73 | 34 | 28 | 72 | 36 | 27 | 71 | 36 | 27 |

As cleared in Table 2, it was confirmed that the suitable level of image mirroring ability value C could be held in Examples 1 to 9 using Transparent toners 1 to 9 even when the degradation of the belt surface was progressed. In Examples 1 to 9, good results were obtained as to the images formed on the supports by any of the electrophotographic system, ink-jet system and printing work system. On the other hand, in Comparative Examples 1 to 7 using Transparent toners 10 to 16 being out of the invention, the image mirroring ability values C were considerably lowered accompanied with the progress of deterioration on the surface of the belt so that the effects obtained in Examples 1 to 9 could not be reappeared.

The invention claimed is:

1. An image forming method including a process for forming a transparent toner layer on an image formed on a support, the method comprising steps of;

supplying a transparent toner on an image on a support, and heating and then cooling the image on the support having the transparent toner while the image on the support having the transparent toner being in contact with a belt, wherein the transparent toner contains a resin comprised of a polyester, a styrene-acryl copolymer, a monoester compound represented by Formula I, and a hydrocarbon compound having at least one of a branched chain structure and a cyclic structure, Formula I: $R^1—COO—R^2$ wherein, $R^1$ and $R^2$ are each a hydrocarbon group having 13 to 30 carbon atoms which may have a substituent or not, and $R^1$ and $R^2$ are the same or different, wherein the transparent toner is supplied to whole surface of the support having an image;

the method is repeated; and the belt is degraded after the method is repeated.

2. The image forming method of claim 1, wherein the resin has a peak within a range of 10,000 to 30,000 and a peak within a range of 40,000 to 100,000 in weight average molecular weight distribution.

3. The image forming method of claim 1, wherein the polyester resin has a weight-average molecular weight (Mw) of 20,000 to 100,000 determined by gel permeation chromatography.

4. The image forming method of claim 1, wherein the polyester resin has a number-average molecular weight (Mn) of 2,000 to 80,000 determined by gel permeation chromatography.

5. The image forming method of claim 1, wherein the polyester resin has a glass transition point of 20 to 90° C.

6. The image forming method of claim 5, wherein the polyester resin has a glass transition point of 35 to 65° C.

7. The image forming method of claim 1, wherein the polyester resin has a softening point of 80 to 220° C.

8. The image forming method of claim 7, wherein the polyester resin has a softening point of 80 to 150° C.

9. The image forming method of claim 1, wherein the styrene-acryl copolymer has a weight average molecular weight (Mw) of 2,000 to 1,000,000.

10. The image forming method of claim 1, wherein the styrene-acryl copolymer has a number average molecular weight (Mn) of 1,000 to 100,000.

11. The image forming method of claim 1, wherein the styrene-acryl copolymer has a molecular weight distribution (Mw/Mn) from 1.5 to 100.

12. The image forming method of claim 11, wherein the styrene-acryl copolymer has a molecular weight distribution (Mw/Mn) from 1.8 to 70.

13. The image forming method of claim 1, wherein the styrene-acryl copolymer has a glass transition temperature point of 30 to 70° C.

14. The image forming method of claim 13, wherein the styrene-acryl copolymer has a softening point of 80 to 170° C.

15. The image forming method of claim 1, wherein the monoester compound represented by the Formula I has a melting point of 30 to 100° C.

16. The image forming method of claim 15, wherein the monoester compound represented by the Formula I has a melting point of 39 to 90° C.

17. The image forming method of claim 1, wherein the hydrocarbon compound having a branched chain structure is microcrystalline wax or iso-paraffin wax.

18. An image forming method including a process for forming a transparent toner layer on an image formed on a support, the method comprising steps of:

supplying a transparent toner on an image on a support, fixing the image on the support, and then heating and then cooling the image on the support having the transparent toner while the image on the support having the transparent toner being in contact with a belt, wherein the transparent toner contains a resin comprised of a polyester, a styrene-acryl copolymer, a monoester compound represented by Formula 1, and a hydrocarbon compound having at least one of a branched chain structure and a cyclic structure, Formula 1: $R^1—COO—R^2$ wherein, $r^1$ and $R^2$ are each a hydrocarbon group having 13 to 30 carbon atoms which may have a substituent or not, and $R^1$ and $R^2$ are the same or different, wherein the transparent toner is supplied to whole surface of the support having an image;

the method is repeated; and the belt is degraded after the method is repeated.

* * * * *